US005657057A

United States Patent [19]

Nakajima et al.

[11] Patent Number: 5,657,057

[45] Date of Patent: Aug. 12, 1997

[54] REMAINING INK DETECTION IN AN INK JET RECORDING APPARATUS

[75] Inventors: Hiroharu Nakajima, Chiba; Noboru Shimoyama, Yokohama; Noriyuki Sugiyama, Kawasaki; Yasufumi Tanaami, Tokyo, all of Japan

[73] Assignee: Canon Kabushiki Kaisha, Tokyo, Japan

[21] Appl. No.: 998,838

[22] Filed: Dec. 30, 1992

[30] Foreign Application Priority Data

| | | | |
|---|---|---|---|
| Jan. 7, 1992 | [JP] | Japan | 4-000708 |
| Jan. 7, 1992 | [JP] | Japan | 4-000709 |
| Dec. 25, 1992 | [JP] | Japan | 4-345829 |

[51] Int. Cl.[6] ..... B41J 2/195

[52] U.S. Cl. ..... 347/7; 347/14; 347/85

[58] Field of Search ..... 346/139 R, 140 R; 400/126, 322, 703; 347/7, 14, 49, 85–87, 5; B41J 2/175, 19/18, 29/38, 29/42, 29/46

[56] References Cited

U.S. PATENT DOCUMENTS

| | | | |
|---|---|---|---|
| 4,313,124 | 1/1982 | Hara | 346/140 R |
| 4,345,262 | 8/1982 | Shirato et al. | 346/140 R |
| 4,459,600 | 7/1984 | Sato et al. | 346/140 R |
| 4,463,359 | 7/1984 | Ayata et al. | 346/1.1 |
| 4,558,333 | 12/1985 | Sugitani et al. | 346/140 R |
| 4,608,577 | 8/1986 | Hori | 346/140 R |
| 4,631,558 | 12/1986 | Hara | 346/140 R |
| 4,723,129 | 2/1988 | Endo et al. | 346/1.1 |
| 4,740,796 | 4/1988 | Endo et al. | 346/1.1 |
| 4,832,518 | 5/1989 | Moriyama | 400/322 |
| 5,049,898 | 9/1991 | Arthur et al. | 347/14 X |
| 5,179,389 | 1/1993 | Arai et al. | 347/7 |

FOREIGN PATENT DOCUMENTS

| | | | |
|---|---|---|---|
| 0449625 | 10/1991 | European Pat. Off. . | |
| 54-056847 | 5/1979 | Japan . | |
| 59-123670 | 7/1984 | Japan . | |
| 59-138461 | 8/1984 | Japan . | |
| 60-071260 | 4/1985 | Japan . | |
| 62-15415 | 1/1987 | Japan | 347/7 |
| 62-025216 | 2/1987 | Japan | B41J 2/175 |
| 2-078557 | 3/1990 | Japan | B41J 2/175 |
| 3218845 | 9/1991 | Japan . | |
| 4-141442 | 5/1992 | Japan | B41J 2/175 |

*Primary Examiner*—Mark J. Reinhart
*Assistant Examiner*—Charlene Dickens
*Attorney, Agent, or Firm*—Fitzpatrick, Cella, Harper & Scinto

[57] ABSTRACT

A carriage on which an ink tank is mounted is moved acceleratively. Next, under this accelerative movement, a period of time spent moving a designated distance is measured. Finally, the amount of ink fluids in the ink tank is detected by the measured period of time and a message related to the amount of ink fluids is displayed. With these procedures, in an ink jet recording apparatus in which the ink tank for storing ink fluids to be supplied to the recording head is mounted on the carriage, the amount of ink fluids remaining in the ink tank can be detected using simplified structure.

40 Claims, 24 Drawing Sheets

| VALUE "a" OF THE AREA 1041 IN RAM | CORRECTION VALUE "b" |
|---|---|
| $0 \leqq a < 150{,}000$ | 0 mSec |
| $150{,}000 \leqq a < 300{,}000$ | 0.1 mSec |
| $300{,}000 \leqq a < 450{,}000$ | 0.2 mSec |
| $450{,}000 \leqq a < 600{,}000$ | 0.3 mSec |
| $600{,}000 \leqq a < 750{,}000$ | 0.4 mSec |
| $750{,}000 \leqq a < \infty$ | 0.5 mSec |

FIG.11

| VALUE "a" OF THE AREA 1041 IN RAM | CORRECTION VALUE "b" |
|---|---|
| $40^\circ c < a$ | 0.2 m Sec |
| $30^\circ c < a \leqq 40^\circ c$ | 0.1 m Sec |
| $20^\circ c < a \leqq 30^\circ c$ | 0 m Sec |
| $10^\circ c < a \leqq 20^\circ c$ | −0.1 m Sec |
| $0^\circ c \leqq a \leqq 10^\circ c$ | −0.2 m Sec |
| $a < 0^\circ c$ | −0.3 m Sec |

FIG.13

| VALUE"a"OF THE AREA 1041 IN RAM | ENVIRONMENT CORRECTION VALUE |
|---|---|
| $40 < a$ | −0.06 |
| $30 < a \leqq 40$ | −0.04 |
| $20 < a \leqq 30$ | 0 |
| $10 < a \leqq 20$ | 0.04 |
| $0 < a \leqq 10$ | 0.08 |
| $a \leqq 0$ | 0.10 |

FIG.17

| VALUE "b" OF THE AREA 1042 | HEAT CORRECTION VALUE |
|---|---|
| $70 \leqq a$ | −0.25 |
| $60 \leqq a < 70$ | −0.22 |
| $50 \leqq a < 60$ | −0.18 |
| $40 \leqq a < 50$ | −0.15 |
| $30 \leqq a < 40$ | −0.12 |
| $20 \leqq a < 30$ | −0.08 |
| $10 \leqq a < 20$ | −0.05 |
| $0 \leqq a < 10$ | −0.02 |
| $a < 0$ | 0 |

FIG.18

REMAINING INK DETECTION IN AN INK JET RECORDING APPARATUS

BACKGROUND OF THE INVENTION

1. Field of the Invention

The present invention relates to an ink jet recording apparatus, more specifically, an ink jet recording apparatus having a recording head mounted on a carriage moving while recording and an ink storage unit storing ink fluids also mounted on the carriage.

2. Description of the Related Art

As known generally, in an ink jet recording apparatus categorized as a serial type recording apparatus, an image is recorded on a recording medium such as recording sheets by ejecting ink fluids from a recording head in accordance with the movement of a carriage on which the recording head is mounted. This type of recording head has an orifice, an ink passage connected to the orifice in which an energy generation device is formed for generating thermal energy used for ejecting ink fluids, and a common fluid reservoir connected to the ink passage for storing ink fluids.

As for the ink storing unit such as an ink tank for storing ink fluids to be supplied to the recording head, there are two cases with respect to its installation into the recording apparatus; one is a case that the ink storing unit is mounted on a fixed position in the ink jet recording apparatus, and the other is a case that the ink storing unit is mounted on the carriage together with the recording head. In the former case, an ink supply route between the recording head and the ink storing unit is formed so as to trace the movement of the carriage during the recording operations.

In the latter case, it is possible to shorten the length of the ink supply route between the recording head and the ink storing unit. Therefore, this structure where the ink storing unit is mounted on the carriage is an adaptive structure for forming a small-sized and simplified recording apparatus.

Among variations of the structure in which the ink storing unit and the recording head are mounted together, what is adopted popularly today is a structure in which the recording head and the ink tank are integrally formed in a single assembly module so that both of the recording head and the ink tank can be replaced for new ones when the ink tank gets to be empty. This single-module structure makes it easier to fabricate and maintain the overall components of the recording apparatus.

In using this type of recording head fabricated with a single-module-structured ink tank, the following specific and generic problems occur.

At first, in order to determine the timing of replacing the recording head and the ink tank, the structure of the recording head is expected to have a sub-structure for detecting the amount of ink fluids remaining in the ink tank. Among the conventional ways and structures for detecting the amount of ink fluids, it is generally well known that the amount of ink fluids can be detected by measuring an electric resistance between two adjacent electrodes inserted into the ink tank.

However, in the above structure for detecting the amount of ink fluids, there is no habit to detect the amount of ink fluids in several levels discretely, and in such a case, there is another problem such that the number of electrodes required for establishing fine-pitched detection of the amount of ink fluids becomes larger, which makes the structure of the recording head more complex.

Next, in the conventional ink jet recording apparatus, there is no habit to control the ejection driving in response to the amount of ink fluids remaining in the ink tank. This may cause, in case the ink tank is almost empty, the refill of ink fluids from the common fluid reservoir to the ink passage not to be fully established response to ejecting ink fluids from the recording head, which is ultimately caused by the relative change in the pressure drop between the recording head and the ink tank. In such a case, in the conventional ink jet recording apparatus, any specific compensational control for ejecting ink fluids from the recording head is not performed. Owing to this, there may be ejection failures in prior art apparatus which leads to the reduction of the quality of recorded images.

Finally, though it is desirable to do some specific operations for verifying the ejection power of the replaced recording head when the recording head and the ink tank are replaced with new ones, there is no consideration in the conventional ink jet recording apparatus. In such a case, in order to verify the ejection power of the recording head, the operator must manipulate directly the recording apparatus, which may increase the load of the operator or may cause even some accident or damage in a series of operations unfamiliar to the operator.

A typical example of these specific operations is an ejection restoration operation. In the ejection restoration operation, ink fluids filled in the ink passage are forced to be removed from the orifice by evacuation or pressurization, or dummy ejection operations are performed in a designated position in the recording apparatus, both of which are used for removing viscous ink fluids remaining in the ink passage.

The reason why it is effective to perform ejection restoration operations when the recording head is replaced, is that the ink fluids in the neighboring area to the orifice get to be most viscous among ink fluids filled from the common fluid reservoir to the top of the orifice in case of using a single-module of a recording head and an ink tank.

SUMMARY OF THE INVENTION

The object of the present invention is to provide an ink jet recording apparatus which enables to execute automatically operations with respect to the replacement of the recording head and the ink storing unit both mounted on the carriage.

Another object of the present invention is to provide an ink jet recording apparatus which enables to detect the amount of ink fluids with a simple structure in the ink storing unit mounted on the carriage.

Further object of the present invention is to provide an ink jet recording apparatus which enables to control ejection driving operations optimally in responsive to the amount of ink fluids detected in the ink storing unit.

And further object of the present invention is to provide an ink jet recording apparatus which enables to replace the ink storing unit automatically by detecting the timing for replacing the ink storing unit in responsive to the amount of ink fluids detected in the ink storing unit.

In the first aspect of the present invention, an ink jet recording apparatus for recording an image by ejecting ink on a recording medium by using a recording head for ejecting ink comprises:

- a carriage, on which an ink storage unit for storing ink supplied to the recording head can be mounted, being formed so as to be movable;
- a driving means for moving the carriage;
- a datum detecting means for detecting a datum related to a moving velocity of the carriage on which the ink storage unit is mounted; and an ink amount detecting means for detecting an amount of ink stored in the ink storage unit on a basis of the datum detected by the datum detecting means.

The datum related to the moving velocity may be an average velocity or an acceleration rate in an acceleration region or a slowing-down region in the carriage movement.

The ink amount detecting means may correct the datum related to the moving velocity on a basis of a period of a used time of the ink jet recording apparatus.

The ink amount detecting means may correct the datum related to the moving velocity on a basis of an environment temperature around the ink jet recording apparatus.

The driving means may have a motor and moves the carriage by a driving force of the motor.

The ink amount detecting means may correct the datum related to the moving velocity on a basis of a temperature of the motor.

In the second aspect of the present invention, an ink jet recording apparatus for recording an image by ejecting ink on a recording medium by using a recording head for ejecting ink comprises:

a carriage, which an ink storage unit for storing ink supplied to the recording head can be freely mounted on and removed from, being formed so as to be movable;

a mount judgment means for judging whether the ink storage unit is mounted on the carriage or not;

a datum detecting means for detecting a datum related to a moving velocity of the carriage; and an ink amount detecting means for detecting an amount of ink stored in the ink storage unit on a basis of the datum detected by the datum detecting means and in a manner in responsive to a judgment result of the mount judgment means.

When the mount judgement means judges that the ink storage unit is not mounted, the ink amount detecting means may detect the amount of ink stored in the ink storage unit on a basis of both of the data detected by the datum detecting means in both cases that the ink storage unit is mounted and that the ink storage unit is not mounted.

The ink amount detecting means may detect the amount of ink stored in the ink storage unit on a basis of both of the data detected by the datum detecting means in both cases that the ink storage unit is mounted and that the ink storage unit is not mounted.

When the mount judgement means judges that the ink storage unit is mounted, the ink amount detecting means may detect the amount of ink stored in the ink storage unit on a basis of an amount of ink estimated by a recorded amount of the ink jet recording apparatus and on a basis of the datum detected by the datum detecting means.

In the third aspect of the present invention, an ink jet recording apparatus for recording an image by ejecting an ink on a recording medium by using a recording head for ejecting an ink comprises:

a carriage, on which an ink storage unit for storing ink supplied to the recording head can be mounted, being formed so as to be movable;

a driving means for moving the carriage;

a datum detecting means for detecting a datum related to a moving velocity of the carriage on which the ink storage unit is mounted;

an ink amount estimation means for estimating an amount of ink on a basis of a recorded amount of the ink jet recording apparatus; and an ink amount detecting means for detecting an amount of ink stored in the ink storage unit on a basis of the datum detected by the detecting means and the amount of ink estimated by the ink amount estimation means.

The ink amount detecting means may detect the amount of ink when the recording medium does not exist in a ink ejection region of the recording head.

The ink amount detecting means may detect the amount of ink in accordance with a recorded amount of the ink jet recording apparatus.

The ink amount detecting means may detect the amount of ink in accordance with a period of a used time for recording by the ink jet recording apparatus.

The ink amount detecting means may detect the amount of ink when the ink jet recording apparatus is not operated for a recording operation.

The driving means may move the carriage by a driving force of a motor; and the detecting means has a sensor for detecting the carriage, detects a position of the sensor on a basis of a period of time between a rise time or a fall time of a phase signal to the motor and a rise time or a fall time of a detection signal from the sensor, respectively, the detection being performed in a finer resolution than a resolution of the phase signal, and adds the detected position of the sensor into the datum related to a moving velocity.

An electric power supplied to the sensor may be turned on only when the ink amount detecting means performs the detection procedure.

The ink amount detecting means may detect the amount of ink on a basis of datum related to the moving velocity detected in past by the datum detecting means and on a basis of datum related to the moving velocity detected at present by the datum detecting means.

The ink amount detecting means may further comprise an ink amount reservation judgment means for judging whether the amount of ink detected in past by the ink amount detecting means can be used or not for detecting the amount of ink; and the ink amount detecting means may further detect the amount of ink stored in the ink storage unit in a manner in responsive to a judgment result by the ink amount reservation judgment means.

In the case that the ink amount reservation judgment means judges that the amount of ink detected in past can not be used for the detection procedure of the amount of ink, by performing a plurality of movement of the carriage, each movement starting at different positions from one another, the ink amount detecting means may detect the amount of ink on a basis of data related to the plurality of moving velocity corresponding to the plurality of movement of the carriage.

An ink jet recording apparatus may further comprise an exchange judgment means for judging whether the ink storage unit is replaced for a new ink storage unit or not on a basis of the amount of ink detected in past, in case that the ink amount reservation judgment means judges that the amount of ink detected in past can be used for the detection procedure of the amount of ink.

In the fourth aspect of the present invention, an ink jet recording apparatus for recording an image by ejecting ink on a recording medium by using a recording head for ejecting ink comprises:

a carriage, on which an ink storage unit for storing ink supplied to the recording head can be mounted, being formed so as to be movable;

a driving means for moving the carriage;

a datum detecting means for detecting a datum related to a moving velocity of the carriage on which the ink storage unit is mounted;

an ink amount detecting means for detecting an amount of ink stored in the ink storage unit on a basis of the datum detected by the datum detecting means; and an exchange judgment means for judging whether the ink storage unit is replaced for a new ink storage unit or not on a basis of the amount of ink detected by the ink amount detecting means in past.

An ink jet recording apparatus may further comprise an ejection restoration means for performing an ejection restoration operation for the recording head, the ejection restoration means performing the restoration operation in case that the exchange judgment means judges that the ink storage unit may be replaced for a new ink storage unit.

In the fifth aspect of the present invention, an ink jet recording apparatus for recording an image by ejecting ink on a recording medium by using a recording head for ejecting ink comprises:

a carriage, on which an ink storage unit for storing ink supplied to the recording head can be mounted, being formed so as to be movable;

a driving means for moving the carriage;

a datum detecting means for detecting a datum related to a moving velocity of the carriage on which the ink storage unit is mounted; and a head driving control means for changing a driving condition for the recording head in responsive to the datum detected by the datum detecting mean.

The recording head may make a bubble generated in an ink by using thermal energy and may eject the ink in responsive to the generation of the bubble.

The above and other objects, effects, features and advantages of the present invention will become more apparent from the following description of embodiments thereof taken in conjunction with the accompanying drawings.

BRIEF DESCRIPTION OF THE DRAWINGS

FIG. 11 is a schematic diagram of a correction table used in embodiment 3;

FIG. 13 is a schematic diagram of a correction table used in embodiment 4 of the present invention;

FIG. 17 is a schematic diagram of a correction table used in embodiment 5;

FIG. 18 is a schematic diagram of a correction table similarly used in embodiment 5;

DESCRIPTION OF PREFERRED EMBODIMENTS

In the following, by referring to accompanying drawings, embodiments of the present invention are more fully described in the detailed description.

(General Explanation)

Figure 1A:
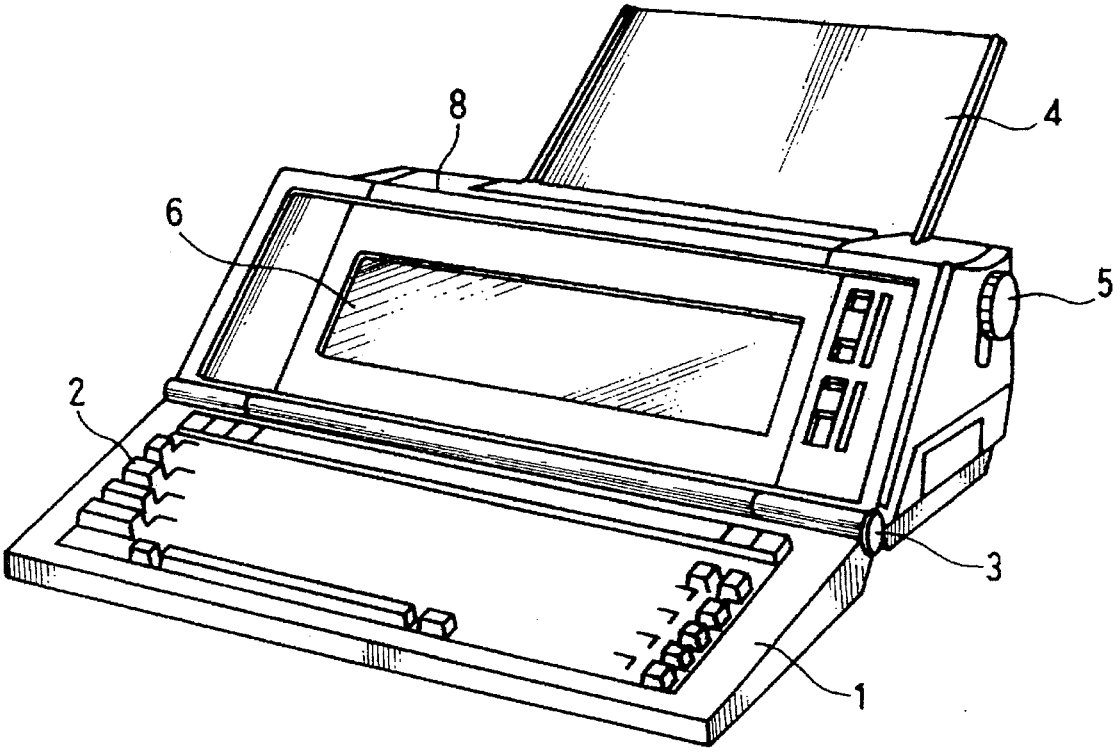
FIGS. 1A and 1B are perspective views showing an electric typewriter in which an ink jet recording apparatus of the present invention is used as a recording part.
Figure 1B:
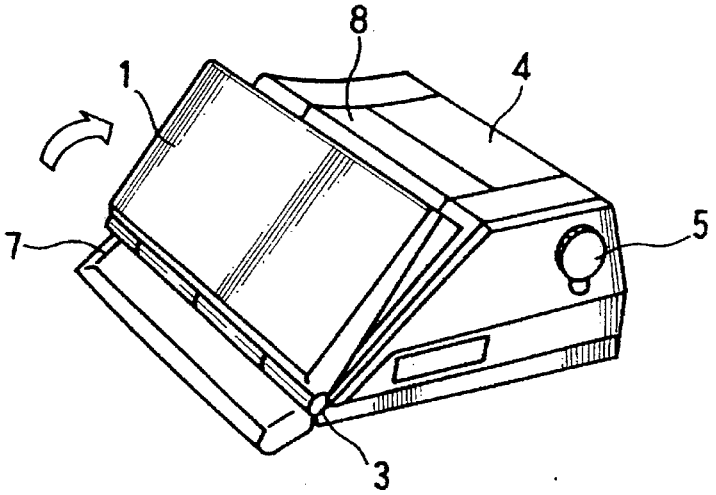

FIGS. 1A and 1B show examples of external view and structure of an electronic typewriter as an apparatus to which the present invention can be applied.

In a keyboard part 1, what are placed are a set of keys 2 which include keys for inputting characters such as alphabetics and numerics, position control keys such as a return key used for requesting print-out procedures, and various kinds of command keys. The keyboard part 1 can be folded as shown in FIG. 1B by rotating the keyboard around a hinge 3 when not used. A paper supply tray 4 is used for supplying recording medium such as sheet papers into a printer part inside the apparatus, which is fixed closely to the apparatus as covering up the apparatus as shown in FIG. 1B when not used. The component 5 is a feed knob for setting and removing manually the recording medium, the component 6 is a display part for displaying stored information such as texts, and the component 7 is a handle used for transporting the apparatus with the present embodiments.

Figure 2:
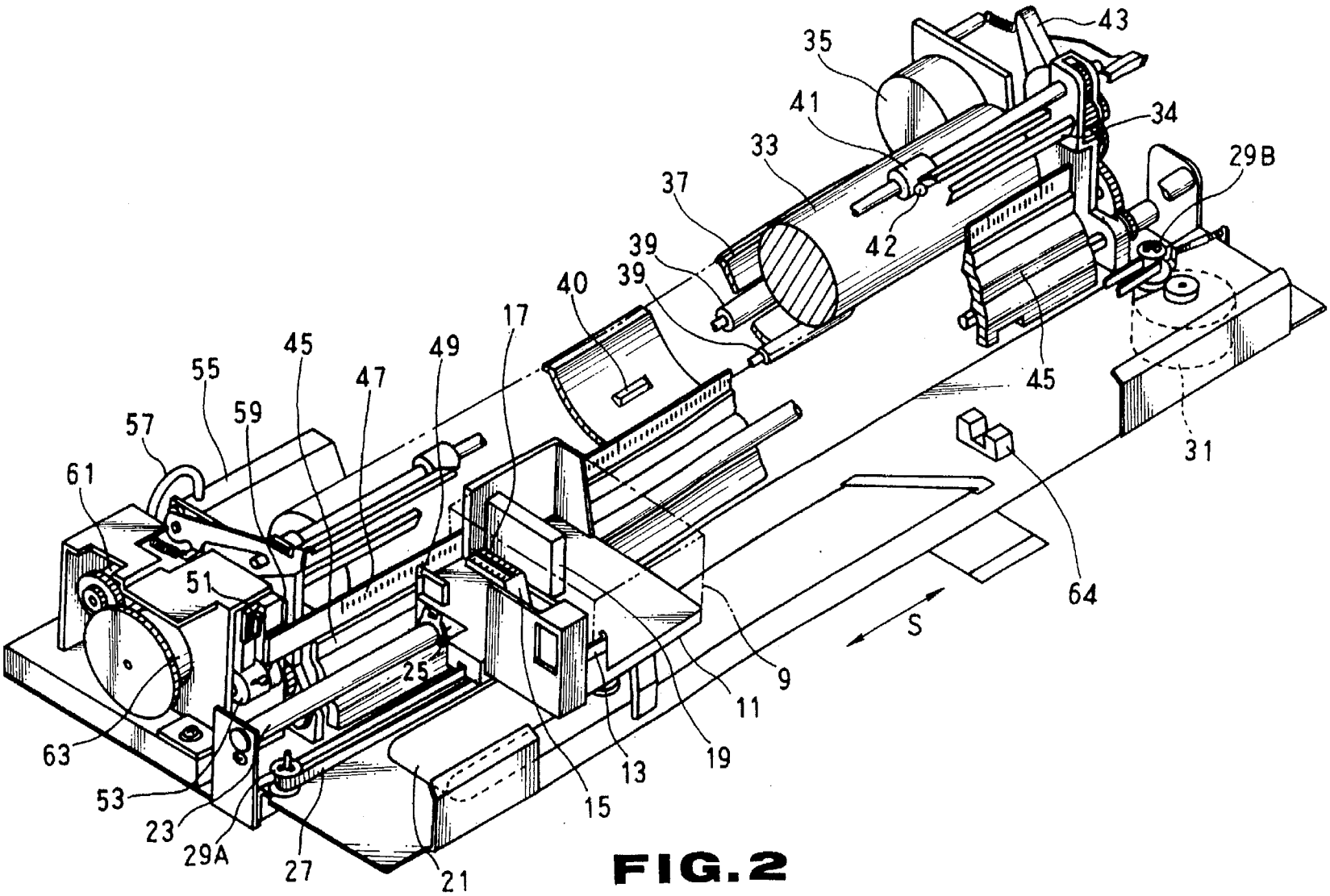
FIG. 2 is a perspective view showing the ink jet recording apparatus used in the typewriter shown in FIGS. 1A and 1B.

FIG. 2 is an example of the structure of the printer part of the electronic typewriter shown in FIG. 1.

In FIG. 2, a head cartridge 9 is composed of an assembly of an ink jet recording head and an ink tank, which is replaced for a new head cartridge with a new ink jet recording head and a new ink tank at the time when the ink fluid in the ink tank is fully exhausted. A carriage 11 on which the head cartridge 9 is mounted is used for scanning the ink jet recording head in the direction shown by an arrow S in FIG. 2. On the carriage 11 are placed a hook 13 for fixing the head cartridge 9 on the carriage 11 and for detaching the head cartridge 9 from the carriage 11 and a lever 15 for manipulating the hook 13 when fixing and detaching the head cartridge 9. On the lever 15, an marker 17 is defined, which is used for enabling the read-out of the current recording positions and predefined control positions of the recording head mounted in the head cartridge 9 by reading the scale defined on the cover to be described later. A support board 19 is also placed on the carriage 11 for fixing the electric connection part connected to the head cartridge 9. A flexible cable 21 is formed by flexible materials for tracing the movement of the carriage 11 so as to connect electrically the electric connection part to the control part in the main part of the apparatus.

A guide 23 placed within the movement region of the carriage 11 is used for guiding the carriage 11 in the direction shown by an arrow S in FIG. 2 by linking with a bearing 25 of the carriage 11 so as to move in the traversing direction. A part of a timing belt 27 is connected to the carriage 11 so as to transfer the driving force for the carriage 11 in the direction shown by an arrow S. In other words, the timing belt 27 is extended between pulleys 29A and 29B placed separately at both ends of the apparatus, and the pulley 29B is driven by a carriage motor 31 by transforming the drive power through the transmission mechanism composed of gears and so on.

A transport roller 33 regulates the recording surface of the recording medium which is designated "recording sheet" in the following as well as transports the recording sheet as the recording operation proceeds while being driven by a transport motor 35. The transport power developed by the transport roller 33 for transporting the recording sheet is generated by means of a press plate 45 that presses the transport roller 33 through the recording sheet. A paper pan 37 guides the recording sheet to the recording position from the paper supply tray 4. A hole part is formed at a part of the paper pan 37, to which a sensor for detecting the position of the recording sheet is placed responsively. A feed roller 39 is placed midway of the path of supplying the recording sheet, which is used for pressing down the recording sheet against the transport roller 33. A platen 34 is placed against the orifice-disposed surface of the head cartridge 9 and used for regulating the surface of the recording sheet. A sheet removal roller 41 is placed downward of the recording position described above in the direction of transporting the recording sheet so as to discharge the recording sheet toward the sheet discharge port not shown in the figure. A roller 42 is placed corresponding to the sheet removal roller 41 so as to press the roller 41 through the recording sheet and develop the transport force in the sheet removal roller 41 for the recording sheet. A reset lever 43 releases the force developed by the feed roller 39, the press plate 45 and the roller 42 so as to insert and fix the recording sheet in a designated recording position.

The press plate 45 develops a transport force for the transport roller 33 transporting the recording sheet and establishes an effective contact state between the recording sheet and the transport roller 33 by preventing the recording sheet from being displaced from a designated contact position near the recording position. As the recording head of the head cartridge 9 is formed as an ink jet recording head for recording images by ejecting ink fluids, the distance between the orifice-disposed surface of the recording head on which orifices for ejecting ink fluids are arranged and the surface of the recording sheet is relatively small and, therefore, this gap between the recording sheet and the orifice-disposed surface must be controlled firmly in order to prevent the direct contact between the recording sheet and the orifice-disposed surface. In order to answer this need, the layout structure of the press plate 45 is effective. A scale 47 is defined on the press plate and a marker 49 on the carriage 11 is defined so as to correspond to the scale 47. With this structure, recording positions and designated control positions of the recording head can be read out.

At the home position, one of the movable positions of the head cartridge 9, the cap 51 which is formed with elastic materials such as rubber is placed so as to contact directly to the orifice-disposed surface of the recording head. The cap 51 is supported so as to be contacted onto and removed from the recording head, and by contacting the cap 51 onto the recording head, the recording head can be protected and the ejection restoration operation for the recording head can be served when the recording operation is not at work. The ejection restoration operation involves ejecting ink fluids so that from the orifice of the recording head by driving energy generation devices generating kinetic energy used for ejecting ink fluids so that, viscous ink fluids which may cause ejection failures are removed, which is designated "dummy ejection", or discharging viscous ink fluids in the ink passage of the recording head are by using a pump 53 generating a evacuation force, which is designated "sucking operation". Discharged ink fluids evacuated by the pump 53 are stored in a waste ink tank 55. A component 57 is a tube connecting between the pump 53 and the waste ink tank 55.

A blade 59 is placed for wiping the orifice-disposed surface of the recording head and is supported so as to be moved between the forward position for wiping while the head cartridge travels, at which position the blade 59 is in the moving region of the recording head, and the backward position where the blade 59 is not contacted to the orifice-disposed surface of the recording head. A component 61 is a motor, a component 63 is a cam mechanism for driving the pump 53 by transmitting the driving force from the motor 61 and for moving the cap 51 and the blade 59.

A home sensor 64 contains a photo interrupter and is placed on the base board forming the apparatus frame where the home sensor 64 can be linked with a protruding part (not shown) formed on the bottom part of the carriage 11 responsive to the movement of the carriage 11. Owing to this structure, the protruding part of the carriage 11 is linked with the home sensor 64, and the position in which the protruding part of the carriage blocks the light path for detecting positions is established as a reference position of the carriage 11 in the apparatus of this embodiment. The position occupied by the carriage 11 moved by the carriage motor 31 driven with a designated number of step pulses, which is located in the left side in FIG. 2, can be defined as a home position for ejection restoration operations and so on. The home sensor 64 is used for detecting an average velocity or an acceleration rate of the carriage 11 during its accelerating or slowing down action.

Figure 3:
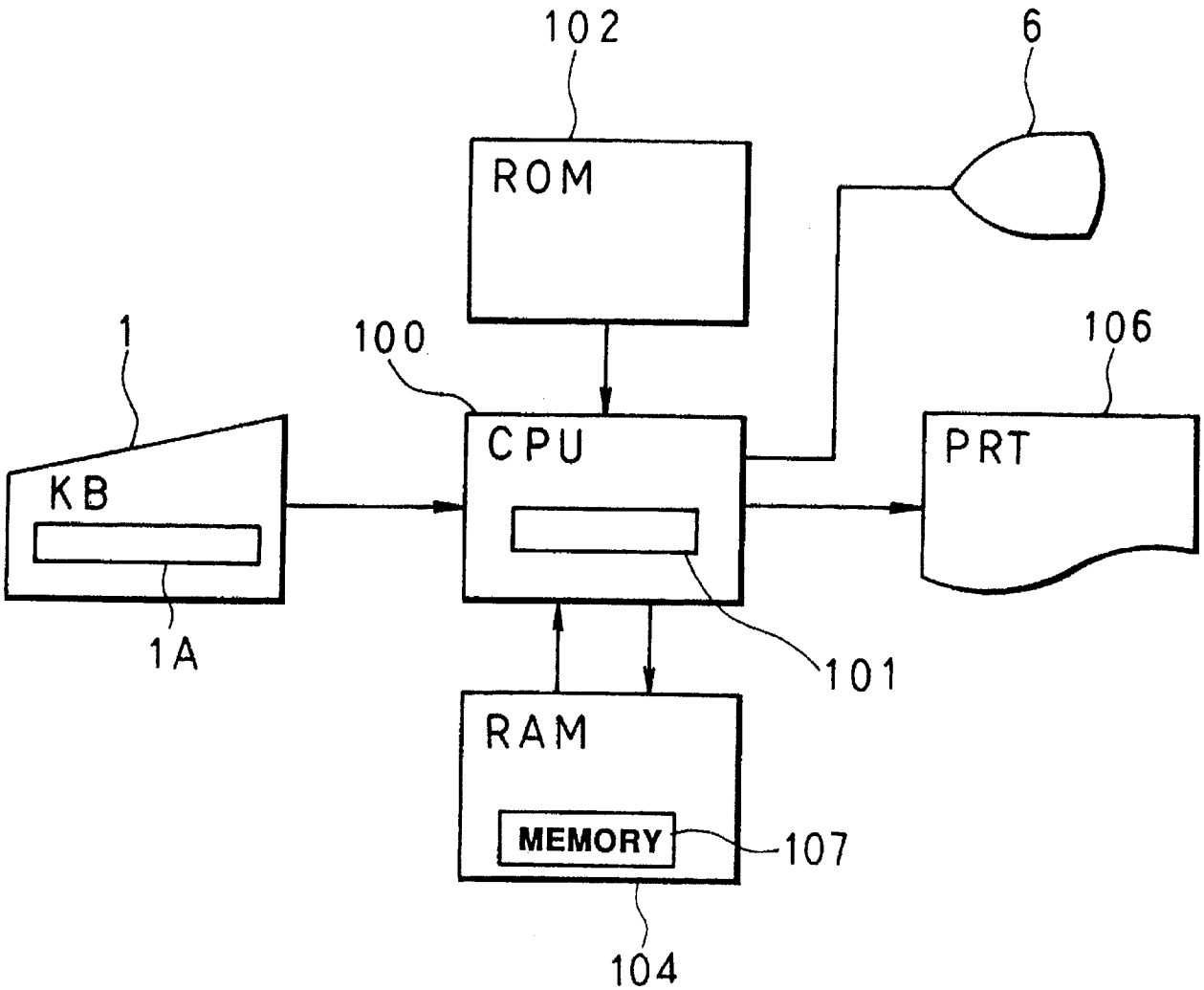
FIG. 3 is a block diagram showing a control structure of the electric typewriter shown in FIG. 1.

FIG. 3 is a block diagram showing an overall control structure in the electronic typewriter shown in FIGS. 1 and 2.

CPU 100 established as to be a microcomputer controls each part of the electronic typewriter responsive to procedures to be described later in FIG. 4 and so on. The timer 101 measures times such as the time spent for moving the carriage to be shown below and the time during which any interruption by key input occurs. In ROM 102, stored are programs corresponding to procedures executed by CPU 100 as well as fixed data used for a character generator and so on. RAM 104 has a memory area for storing recording information and management data as well as a memory area for storing working data processed by CPU 100. In addition RAM 104 has also a memory 107 used with the second embodiment to be disclosed later. The component 106 is an ink jet recording apparatus (the printer part) as described in FIGS. 1 and 2.

In this embodiment, CPU 100 controls the driving operations of the carriage having the recording head and the transport operation of the recording sheet.

In the following, described is a detection of the amount of ink fluids and a detection of the timing of the exchange of the ink tank in the ink jet recording apparatus with its structure described above related to the present invention.

(Embodiment 1)

Figure 4:
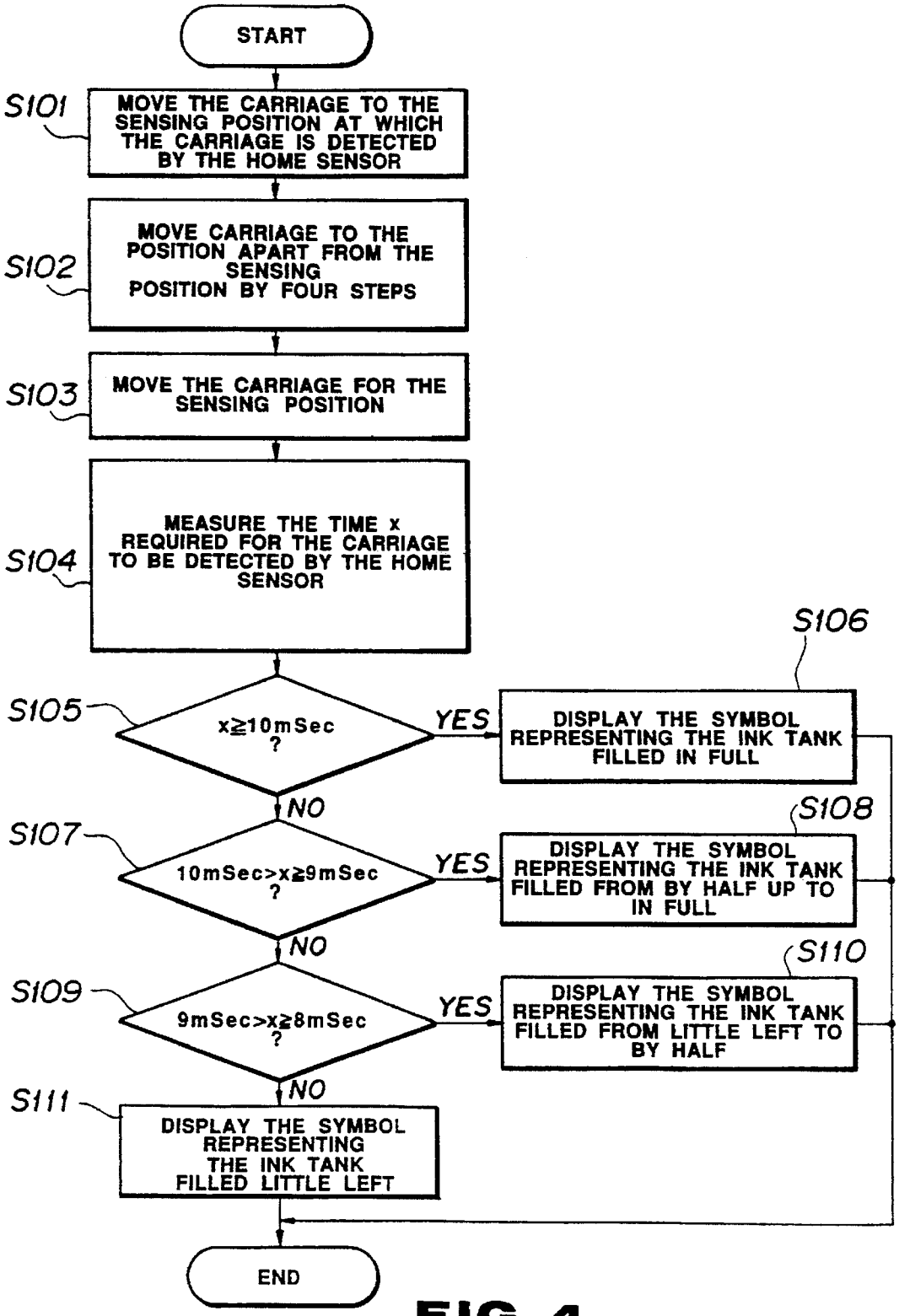
FIG. 4 is a flowchart of an ink amount detecting procedure according to embodiment 1 of the present invention.

FIG. 4 is a flowchart showing procedures for detecting the amount of ink fluids of the first embodiment of the present invention.

The start of procedures in FIG. 4 is invoked by the operator who operates the key 2 in a designated manner for requesting the operation for detecting the amount ink fluids. At first in procedures, in step S101, the carriage 11 having the head cartridge 9 is moved to the position where the home sensor 64 detects the proper position of the carriage and fixed to the position. Next in step S102, the carriage 11 is moved from the fixed position established in step S101 further to the position by driving the carriage motor 31 by four unit steps. This displacement of the carriage 11 equivalent to four unit steps is aimed to establish, as shown in next steps S103 and S104, that a backward movement of the carriage 11 from the displaced position to the fixed position established in step S101 and detected by the home sensor 64 can be defined within the region during which the carriage 11 is in its accelerating operation.

Now that, in step S102, the carriage 11 is moved forward by the displacement equivalent to four unit steps, next in step S103, the carriage 11 is driven by the motor 31 and moved to the position, where the carriage 11 is detected by the home sensor 64, in the direction opposite to that in step S102. In step S104, what is measured is the time x spent while the carriage 11 starts to move from the initial position and gets to the position where the home sensor 64 detects the carriage 11.

The time x depends upon the initial position of the carriage 11 and so on. In this embodiment, the initial position is defined so as to satisfy the following conditions; if x is 10 msec or over the ink tank of the cartridge is almost fully filled with ink fluids; if x is less than 10 msec and equal to or greater than 9 msec, the ink tank is filled with ink fluids by between 50% and 100%; if x is less than 9 msec and equal to or greater than 8 msec, the ink tank is filled with ink fluids by between almost empty and 50%; if x is less than 8 msec, the ink tank is almost empty.

Figure 5:
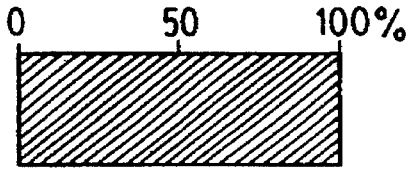
FIG. 5 is a schematic illustration of a display of ink amount in embodiment 1 of the present invention.
Figure 6:
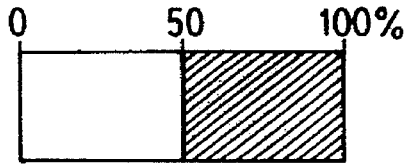
FIG. 6 is a schematic illustration of a display of ink amount in embodiment 1 of the present invention.
Figure 7:
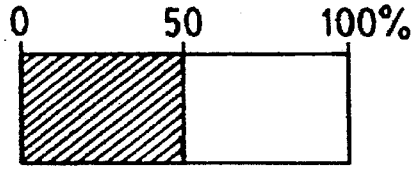
FIG. 7 is a schematic illustration of a display of ink amount in embodiment 1 of the present invention.
Figure 8:
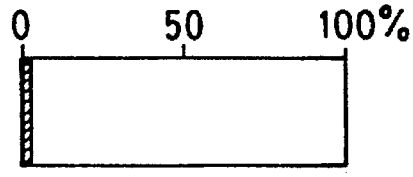
FIG. 8 is a schematic illustration of a display of ink amount in embodiment 1 of the present invention.

In case that x is judged to be equal to or greater than 10 msec in step S105, what is displayed on the display part 6 in step S106 means, as shown in FIG. 5, that the ink tank of the cartridge is almost fully filled with ink fluids, that is, "fully charged". In case that x is judged to be less than 10 msec in step S105, step S107 is selected and it is judged whether or not the time x is less than 10 msec and equal to or greater than 9 msec. In the case that x is judged to be less than 10 msec and equal to or greater than 9 msec, what is displayed on the display part in step S108 means, as shown in FIG. 6, that the ink tank is filled with ink fluids by between 50% and 100%. In case that x is judged to be less than 9 msec, step S109 is selected next in order to judge whether x is less than 9 msec and equal to or greater than 8 msec. If step S109 derives an affirmative decision, that is, x is less than 9 msec and equal to or greater than 8 msec, what is shown on the display part in step S110 selected next means, as shown in FIG. 7, that the ink tank is filled with ink fluids by between almost empty and 50%. In case that step S109 judges that x is less than 8 msec, what is shown on the display part in step Sill means, as shown in FIG. 8, that the ink tank is almost empty.

As described above, the detection of the amount of ink fluids in the ink tank of the head cartridge 9 is performed by measuring the average velocity of the carriage having the ink cartridge moving in its accelerating region, where the average velocity is defined as a time spent for traveling in a designated distance. This can be possible by means that, as the inertial mass of the carriage containing the head cartridge is dependent upon the amount of ink fluids in the ink tank of the head cartridge, the amount of ink fluids can be identified indirectly by measuring directly the average velocity of the carriage in its accelerating region. In this manner, the amount of ink fluids in the ink tank can be detected easily with such a simple structure, which leads to preventing a situation in which the time when the ink tank becomes empty can not be forecasted while the recording operation proceeds.

The time when the detection of the amount of ink fluids is performed may be specified arbitrarily by the operator, for example, the time before a designated amount of recording is performed. It may be also allowed that the detection of the amount of ink fluids is invoked in a designated time interval.

Though, in the above embodiment, the detection of the amount of ink fluids is performed by measuring the average velocity of the carriage having the ink cartridge moving in its accelerating region, the similar effect can be obtained by measuring the average velocity of the carriage having the ink cartridge moving in its slowing-down region. In addition, the similar effect can be obtained by measuring the acceleration rate of the carriage in its accelerating region or the slowing-down rate of the carriage in its slowing-down region.

In embodiment 1 described above, the amount of ink fluids are classified into four cases, each of which is judged numerically and corresponds to one of individual messages; "almost fully charged", "50% or more", "less than 50%" and "almost empty" states. The classification of the amount of ink fluids is not limited to this manner where four cases are defined and hence, it may be allowed, for example, two cases are defined such as "almost 50% or more" and "less than 50%". No matter what the number of discrimination values for classifying cases is, the similar effect to that brought by the above described embodiment can be obtained.

The way of reporting the amount of ink fluids to the operator is not limited to displaying visible messages but allowed for example, to report in sound. In addition, in case that ink fluids are almost exhausted, it may be allowed that the operator is notified by a buzzer as well as visual display information. And furthermore, with respect to displaying messages on the display part, it may be allowed that messages displayed on the display part are distinguished after a designated time or that messages are displayed continuously as long as the power to the apparatus is turned on.

In the above embodiment, with respect to the initial position for measuring the average velocity of the carriage, the position is selected so as to be measured by four unit steps in the distance from the home sensor. The distance between the initial position and the home sensor is not limited to be measured by four unit steps but selected to be an arbitrary value as far as the time when the carriage is detected by the home sensor is located within the acceleration region or within the slowing-down region of the carriage movement. Reference values, 10 msec, 9 msec and 8 msec are determined by interpolation of measured times in the experiment in which what is measured is the velocity and acceleration rate of three head cartridges with the amount of ink fluids in their ink tank being fixed so as to be "almost empty", "about 50%" and "almost fully charged" and the time x is also fixed. Therefore, subject to carriages composed of various materials with individual mass, these reference values may not be valid and but adequate reference values may be determined properly in given conditions.

(Embodiment 2)

Figure 9:
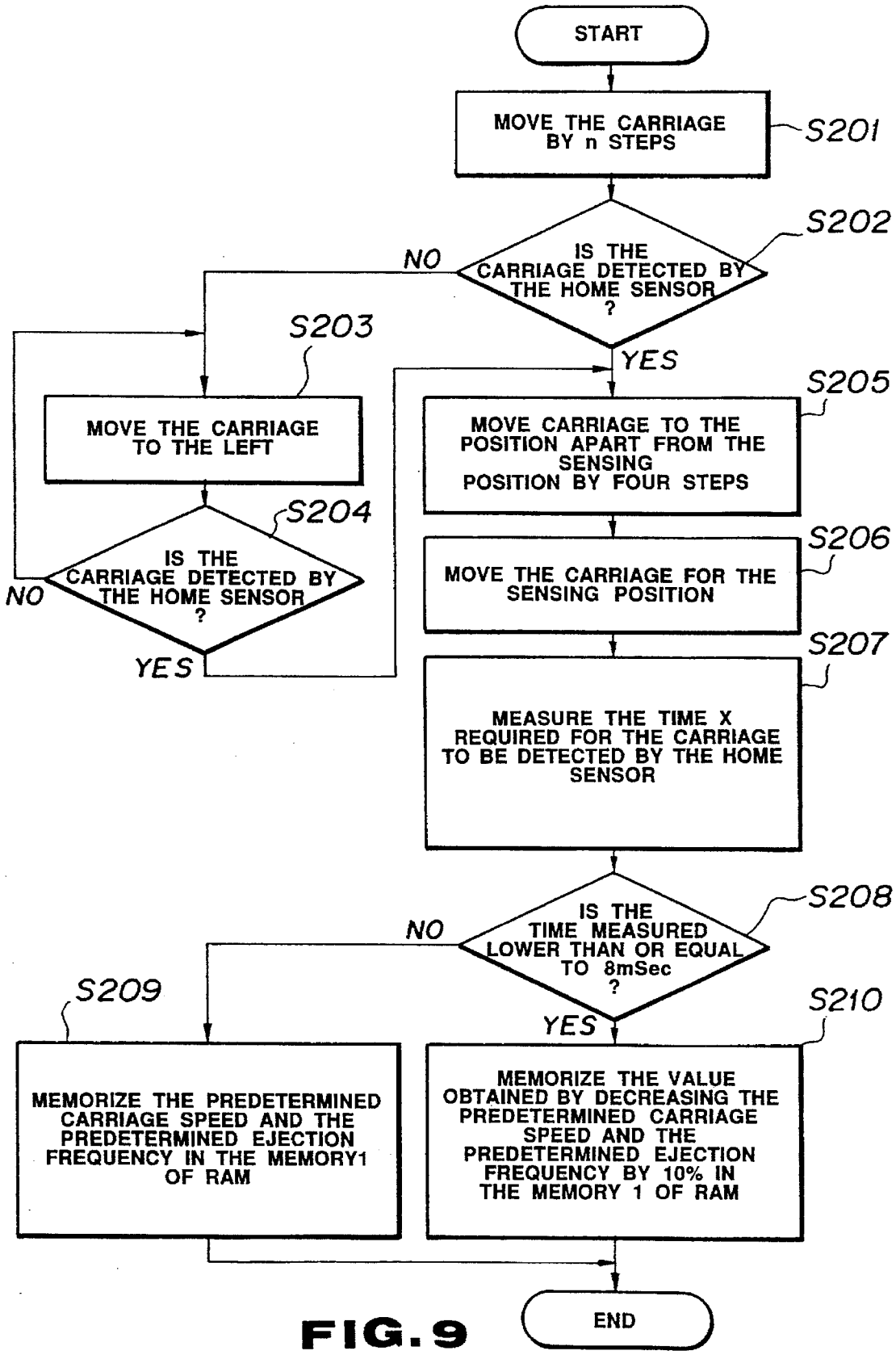
FIG. 9 is a flowchart of an ink amount detecting procedure according to embodiment 2 of the present invention.

In embodiment 1 as described above, the amount of ink fluids in the ink tank is estimated by measuring the average velocity of the carriage having the ink tank in its acceleration and slowing-down regions. In embodiment 2, what is described is an example of ejection frequency control responsive to the amount of ink fluids in order to avoid the delay of refiling ink fluids into the recording head in case that ink fluids in the ink tank is almost empty. FIG. 9 is a flowchart of procedures used with embodiment 2 of the present invention.

The procedures are invoked by turning on the power supply to the recording apparatus. Steps S201 to S204 are used for finding the relative position of the carriage 11 in responsive to the home sensor 64. That is, in step S201, the carriage 11 is moved at first from its initial position by "n" unit steps of the carriage motor 31 in the right direction in FIG. 2. In step S202, what is judged is whether the position of the carriage 11 is detected by the home sensor 64. In case that step S202 judges that the carriage 11 is not detected, step S203 is next selected for moving the carriage 11 further in the left direction. This movement of the carriage 11 continues until the carriage 11 is detected in step S204.

In case that the carriage 11 is detected in step S204 or step S202, step S205 is next selected. In step S205, the carriage is moved to the position in "n" unit steps apart from the position where the carriage 11 is detected by the home sensor 64. After the movement of the carriage is completed in step S205, in step S206, the carriage 11 is moved back to the position where the carriage 11 is detected by the home sensor 64. Next in step S207, measured is the time spent after the carriage 11 began to start from its initial position until the carriage 11 reaches the position where the carriage 11 is detected by the home sensor 64.

The time measured in step S207 reflects the amount of ink fluids in the similar manner to embodiment 1. The threshold value of the velocity of the carriage 11 for specifying a state that the amount of remaining ink fluids is extremely small is about 8 msec.

In step S208, therefore, what is judged is whether the time measured in step S207 is 8 msec or less, that is, whether the amount of residual ink fluids in the ink tank is small. In case that step S208 judges that the time x is longer than 8 msec, that is, recording operations can be continued with remaining ink fluids, step S209 is next selected. In step S209, initial set values for the carriage scanning velocity, for example, 160 cm/sec , and the frequency of ejecting ink fluids, for example, 2.8 KHz are stored in the memory 107 of RAM 104, and thus, recording operations are continued under these operational conditions.

In contrast, in step S208, the time x measured in step S207 is judged to be 8 msec or shorter, which means that the amount of ink fluids is not sufficient enough for continuing recording operations normally, next step S210 is selected. In step S210, set values for the carriage scanning velocity and the frequency of ejecting ink fluids are defined by reducing their initial set values described above, for example, 160 cm/sec and 2.8 KHz, by 10% are stored in the memory 107 of RAM 104. With these modified set values, recording operations are performed. That is, according to these stored set values, ink fluids are ejected from the recording head and the carriage is moved synchronously.

As described above, the initial position of the recording head is defined at the position in a designated distance from the position where the home sensor detects the recording head, and the time for which the recording head travels from its initial position to the position where the home sensor detects the recording head is measured, and furthermore, a control means is formed for reducing the set values for the carriage scanning velocity and the frequency of ejecting ink fluids from their initial values in case that the measured time x becomes lower than a designated value. Owing to this manner, even when ink fluids in the ink tank are almost exhausted, the operation for refilling ink fluids into the ink passage in the recording head immediately after the ink fluids are ejected are not delayed with respect to the frequency of ejecting ink fluids, which leads to removing causes such as ink fluids ejection failures which may ultimately reduce the quality of recorded images.

In the above embodiment 2, steps for detecting the amount of ink fluids and for defining the frequency of ejecting ink fluids are forced to be executed immediately after the power supply to the apparatus is turned on. The similar effect can be brought even by invoking step S205 and thereafter only at the request of the operator performing a specific key operation.

(Embodiment 3)

In the above described embodiments 1 and 2, the amount of ink fluids is estimated by the average velocity of the carriage moving to the home sensor in a designated distance which is derived from the measured time. The time for the carriage moving from its initial position to the home sensor may be subject to the friction load developed between the carriage and the guide shaft. Specifically, the longer the used time of the recording apparatus is, the more the friction load tends to increase which leads to the reduction of accuracy in estimating the amount of ink fluids.

In this embodiment, a means for recording the used time of the recording apparatus is formed, and by correcting the measured time for the recording head moving with a designated value corresponding to the used time, it is aimed that the accuracy of estimating the amount of ink fluids is maintained to be constantly high. Embodiment 3 is described below in detail.

Figure 10:
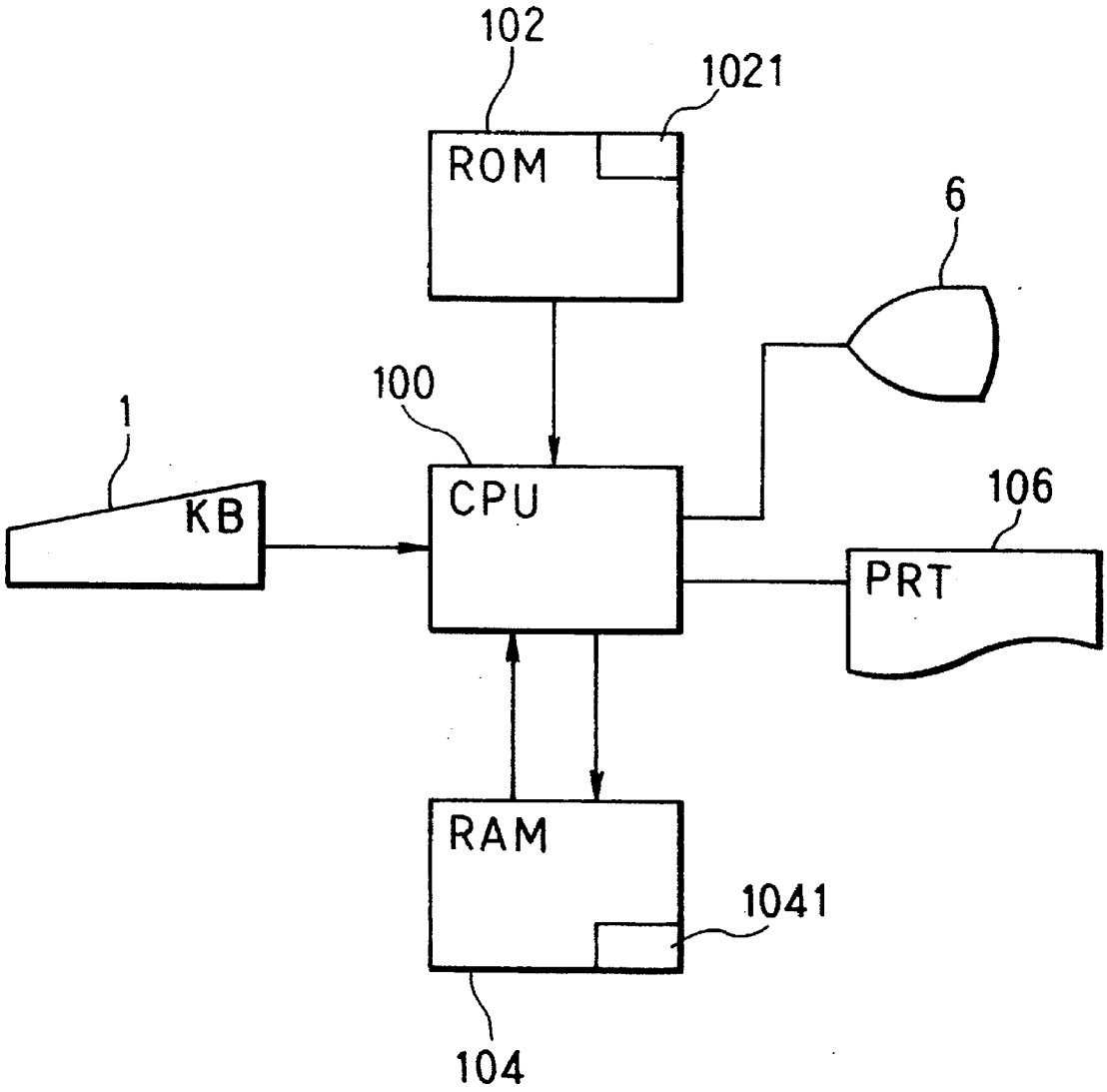
FIG. 10 is a block diagram showing a control structure of an electric typewriter of embodiment 3 of the present invention.

FIG. 10 is a block diagram having the similar control structure to that of FIG. 3, and similar parts have like numbers as defined in FIG. 3.

In R0M 102, programs corresponding to individual procedures executed by CPU 100, fixed data used for the character generator and so on, tables containing signal data for driving individual motors, and correction data 1021 used for detecting the amount of ink fluids are stored. RAM 104 has a memory area used for storing recording information and management, a memory area 1041 storing a recording history of the recording apparatus with this embodiment as a parameter "a", and furthermore a work area for CPU 100.

RAM 104 with this embodiment is reset when the power supply to the recording apparatus is turned on for the first time, that is, the operator uses the apparatus for the first time, and after that, during the operation of the apparatus or the power supply is turned off, the electric supply to RAM 104 is continuously maintained by backup batteries. The memory area 1041 in RAM 104 is also supported by backup batteries and the used time can be always obtained. In this embodiment, the content stored in the memory area 1041 includes the sum of the number of lines recorded on the recording sheets during the use time of the recording apparatus.

As shown in FIG. 11, the correction data stored in ROM 102 is formed in a table in which individual parameters "a" stored in the memory area 1041 of RAM 104 correspond to pertinent correction values "b" which are obtained experimentally.

Procedures executed in the above described architecture are shown in the flowchart shown in FIG. 12 and are described below.

Procedures in steps S301 to S304 are identical to those in steps S101 to S104 shown in FIG. 4, in which the time x is measured for estimating the average velocity of the movement of the cartridge to be used for detecting the amount of the ink fluids.

Next, in step S341, a parameter "a" stored in the memory area 1041 of RAM 104 is read-out and, in step S342, a correction value "b" corresponding to this parameter "a" is selected by referring to the table stored in the memory area 1021 of ROM102. The parameter "a" represents the used time of the recording apparatus with this embodiment, more specifically, the overall number of recorded lines on the recording sheets, and the value "b" is a correction value for the time x dependent on the value of the parameter "a". Now that the value of the correction value "b" is determined in step S342, a new value of the time x is obtained by subtracting the value of "b" from the old value of the time x obtained in step S304.

With the new time x corrected in step S343, in steps S305 to S311, messages related to the amount of ink fluids are displayed in the similar manner to those in steps S105 to S111 shown in FIG. 4.

According to the above procedures, the errors in the measured time x which depends upon the used time of the recording apparatus can be corrected in order to estimate the amount of ink fluids more precisely.

In the above embodiment 3, the correction value of the measured time x is determined by measuring the overall number of recorded lines on the recording sheets. It may be allowed that the correction value "b" is determined by using the number of recorded characters or the number of recorded sheet instead of the number of recorded lines.

And furthermore, it may be allowed that the correction value "b" is not referred from the table but obtained numerically by executing calculation formulae with its programs stored in ROM.

(Embodiment 4)

In the above embodiment 3, the time x for the carriage moving from its initial position to the home sensor is corrected responsive to the used time of the recording apparatus. This is aimed for correcting the effect by which the friction load is changed during the used time.

In embodiment 4, considering that the friction load is changed also due to the environmental temperature, it is aimed that the accuracy in estimating the amount of ink fluids is increased by correcting the temperature effect.

The control architecture with this embodiment is almost similar to that shown in FIG. 10 with embodiment 3, except that the value of the environmental temperature, for example, measured in a designated time interval is stored in the memory area 1041 of RAM 104. In the memory area 1021 of ROM 102, as shown in FIG. 13, the correction data are formed in a table in which individual temperature temperature parameters "a" stored in the memory area 1041 of RAM 104 correspond to pertinent correction values "b" for adjusting the predefined time x.

Figure 12:
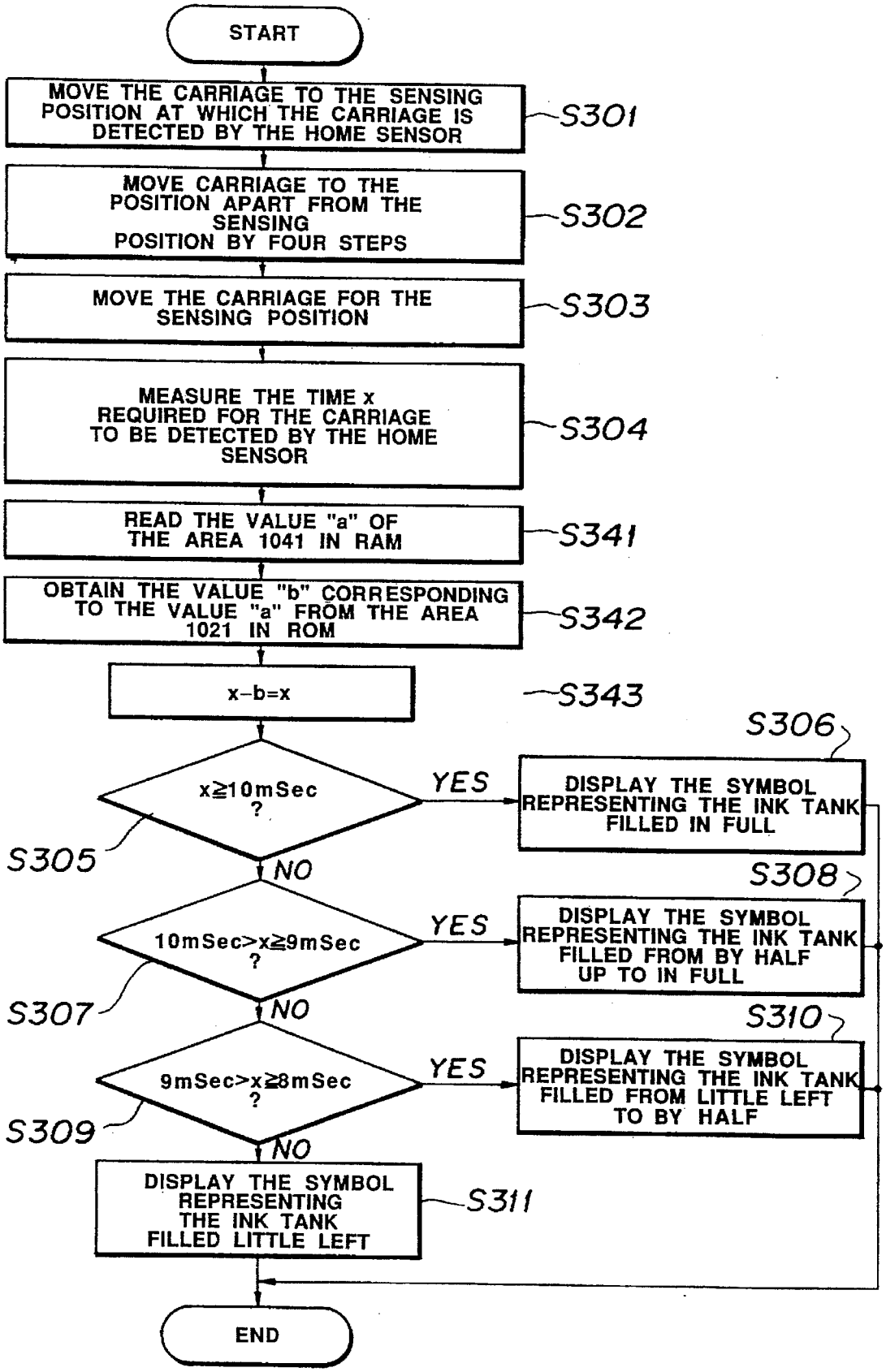
FIG. 12 is a flowchart of an ink amount detecting procedure according to embodiment 3 of the present invention.
Figure 14:
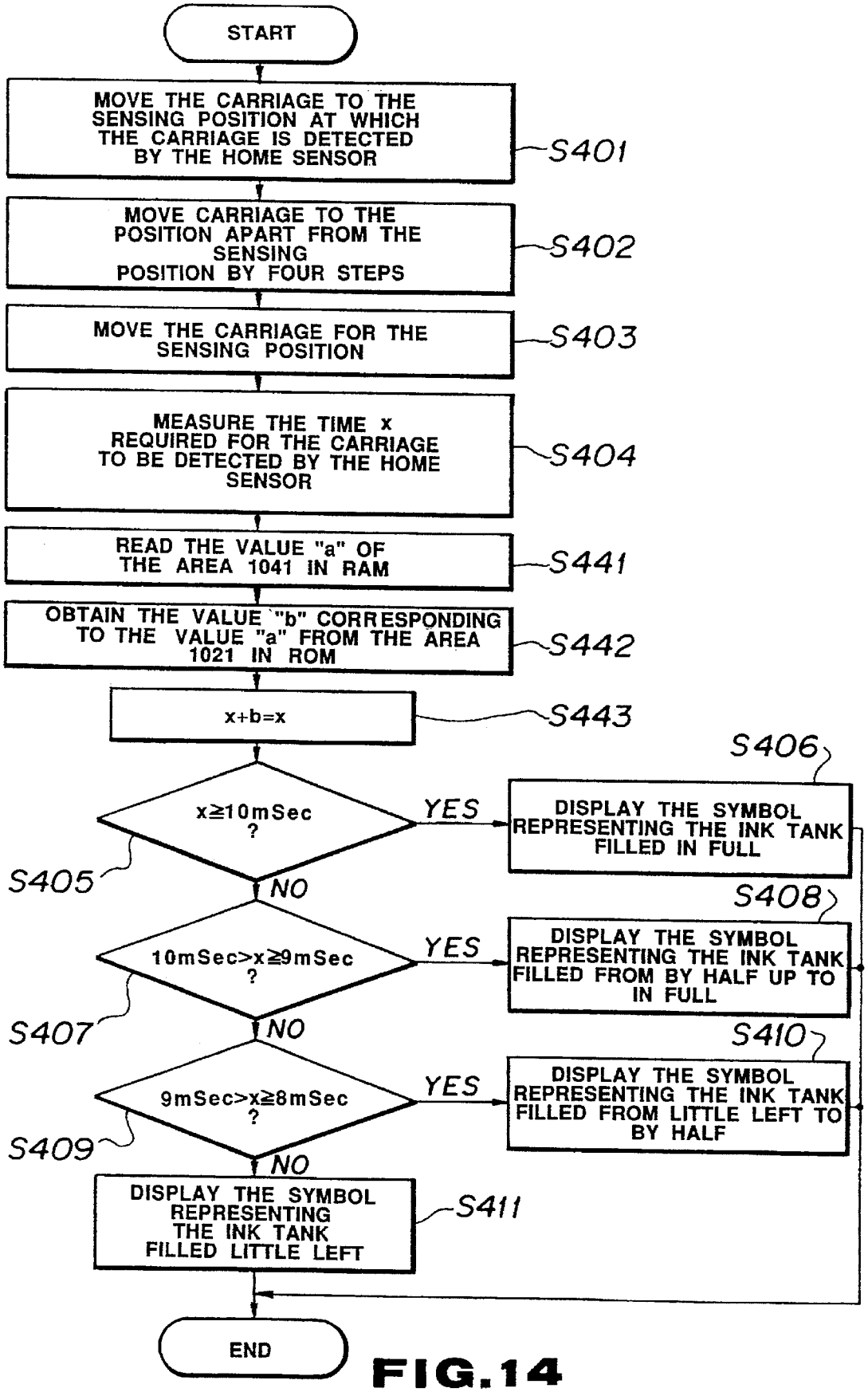
FIG. 14 is a flowchart of an ink amount detecting procedure according to embodiment 4 of the present invention.

FIG. 14 shows a flowchart of procedures with embodiment 4 and its control flow and logic is almost similar to that with embodiment 3 shown in FIG. 12.

In steps S441 to S443, the value "a" of the environmental temperature is referred from the memory area 1041, the correction value "b" for the time x is determined by referring to the table data stored in the memory area 1021 with the value "a", and finally a newly corrected time x is obtained by adding the correcting value "b" to the previously defined time x.

According to the above procedures, the errors in the measured time x which depends upon the environmental temperature change can be corrected in order to estimate the amount of ink fluids more precisely.

Though in the above described embodiment 4, the correction values "b" are stored in a table form, it may be allowed that the correction value "b" is obtained numerically by executing calculation formulae, for example, b=0.01 (a–25), with its programs stored in ROM. In those variational cases, the correction formulae and values are not limited to those generic to embodiment 4 but allowed to be selected arbitrarily, for example, linear or higher order functions with their parameters being obtained by parameter fittings.

And furthermore, in case of referring tables, a plurality of tables may be prepared in a hierarchical manner.

(Embodiment 5)

In this embodiment, the measured moving time x of the carriage is corrected responsive to the temperature of the carriage motor 31 which is a component of the driving mechanism of the carriage.

The operational conditions for driving the carriage motor 31 are subject to its environmental and internal temperature, and in such a case, even with the amount of ink fluids being unchanged, the measured value of the moving time x of the carriage is changed due to the deviation of the temperature of the carriage motor 31. In order to solve this problem, the measured moving time x of the carriage is corrected responsive to the temperature of the carriage motor 31 so that the amount of ink fluids may be estimated more accurately.

Figure 15:
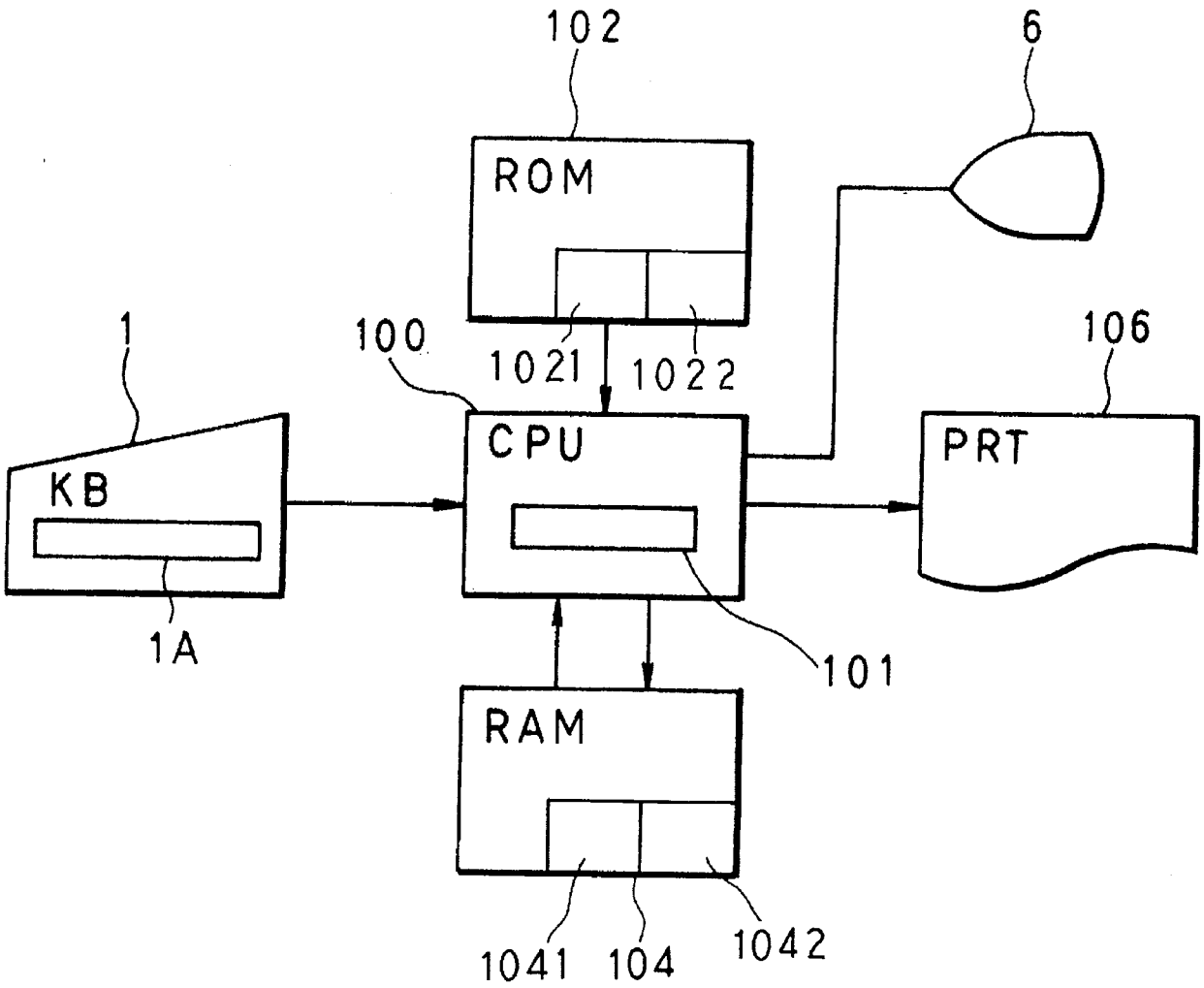
FIG. 15 is a block diagram showing a control structure of an electric typewriter in which an ink jet recording apparatus according to embodiment 5 of the present invention.

FIG. 15 is a block diagram of the control structure of an electronic typewriter with this embodiment. As being apparent in FIG. 15, this control structure is almost similar to that shown in FIG. 3, and therefore, distinctive parts generic to this embodiment will be disclosed in detail.

In ROM 102, stored are programs corresponding to individual procedures, to be described later, executed by CPU 100, fixed data used for the character generator and so on, and tables storing driving signal data for actuators such as the carriage motor 31 as well as correction formulae 1021 and 1022 used for detecting the amount of ink fluids. RAM 104 has a memory area for storing recording information and management as well as a memory area 1042 for recording the temperature of the carriage motor 31 for driving the carriage and a memory area 1041 for recording the environmental temperature of the recording apparatus with this embodiment.

In this embodiment, the content stored in the memory area 1042 of RAM 104 is the temperature of the carriage motor 31 used for driving the carriage, and this temperature is measured by a temperature detection means not shown in FIG. 15. The correction formulae 1021 and 1022 are determined experimentally so that the measured moving time x for the carriage traveling in a designated distance may be corrected by selecting parameters "a" and "b" stored in the memory areas 1041 and 1042, respectively, of RAM 104 and by substituting them into the formulae.

Procedures for detecting the amount of ink fluids which are executed in the above described control architecture of the apparatus with this embodiment are described below by referring to a flowchart shown in FIG. 16.

At first, in step S501, by moving the carriage 11 having a head cartridge 9, the position of the home sensor 64 is detected. Next, in step S502, the carriage 11 is moved toward and fixed at the position in a distance corresponding to two unit steps of the carriage motor 31 from the position where the home sensor 64 is detected. This fixed position of the carriage is determined so that a moving process of the carriage, which is defined from the beginning of moving toward the home sensor 64 to the end of moving until the home sensor 64 is detected, may be within the acceleration region of the carriage 11. After the carriage 11 is moved to the position in a distance corresponding to two unit steps of the carriage motor 31 from the position where the home sensor 64 is detected, next step S503 is selected. In step S503, the carriage 11 is moved back in the direction toward the position where the home sensor 64 is detected. And next, in step S504, measured is the time x for the carriage 11 from starting to move in the direction toward the position where the home sensor 64 is detected and to detecting the home sensor 64.

Next, in steps S505 and S506, the time x is corrected by considering the effect of the environmental temperature around the recording apparatus, and in steps S507 and S508, the time x is further corrected by considering the effect of the heat generation of the carriage motor 31. The environmental temperature around the apparatus and the temperature of the carriage motor 31 are measured by the thermistor not shown in the figure.

The correction of the measured time x is described in detail below. In step S505, the parameter "a" representing the environmental temperature around the recording apparatus is read-out from the memory area 1041 of RAM104, next in step S506, according to the environmental temperature correction formulae 1021 with the parameter "a" read-out in step S505 being substituted, the measured time x is corrected. The environmental temperature correction formulae 1021 is formed by defining the reference temperature as to be 25° C. In case that the environmental temperature is greater than this reference temperature, the measured time x is corrected so as to be decreased because the measured time x may be estimated too much due to the reduction of the hardness of the timing belt 27 for transmitting the driving force from the carriage motor 31 to the carriage 11. In contrast, in case that the environmental temperature is less than the reference temperature, the measured time x is corrected so as to be increased.

Next, in step S507, the value of the parameter "b" is read out from the memory area 1042 of RAM 104 where the heat generation state of the carriage motor 31 is recorded, and furthermore, in step S508, by substituting the values of "b" and "x" into the heat-generation correction formulae 1042 defined experimentally, the effect of the heat generation of the carriage motor 31 on the measured time x is compensated. The heat-generation correction formulae 1042 is obtained experimentally. With this correction formulae, if a temperature rise in the carriage motor due to its heat generation occurs, the measured time x is corrected to be reduced in responsive to the degree of the temperature rise of the carriage motor.

In steps S509 to S515, a message to be displayed on the display part is selected in responsive to the corrected time x by the above described two-step correction procedures. In case that the corrected time x is judged to be 6.4 msec or more in step S509, then step S510 is selected where what is displayed on the display part 6 means that the ink tank is "fully charged". In case that the corrected time x is judged to be less than 6.4 msec in step S509, then step S511 is selected for judging further whether the corrected time x is less than 6.4 msec and 6.2 msec or more. In case that the corrected time x is judged in step S511 to be less than 6.4 msec and 6.2 msec or more, step S512 is selected where what is displayed on the display part 6 means that the ink tank is filled with ink fluids by between 50% and 100%. In case that the corrected time x is judged in step S511 not to be less than 6.4 msec, or 6.2 msec or more, step S513 is selected for further judging whether the corrected time x is less than 6.2 msec and 6.0 msec or more.

In case that step S513 judges that the corrected time x is less than 6.2 msec and 6.0 msec or more, step S514 is selected where what is displayed on the display part 6 means that the ink tank is filled with between almost empty and 50%. In case that step S513 judges that the corrected time x is not less than 6.2 msec and 6.0 msec or more, step S515 is selected where what is displayed on the display part 6 means that the ink tank is almost empty.

Figure 16:
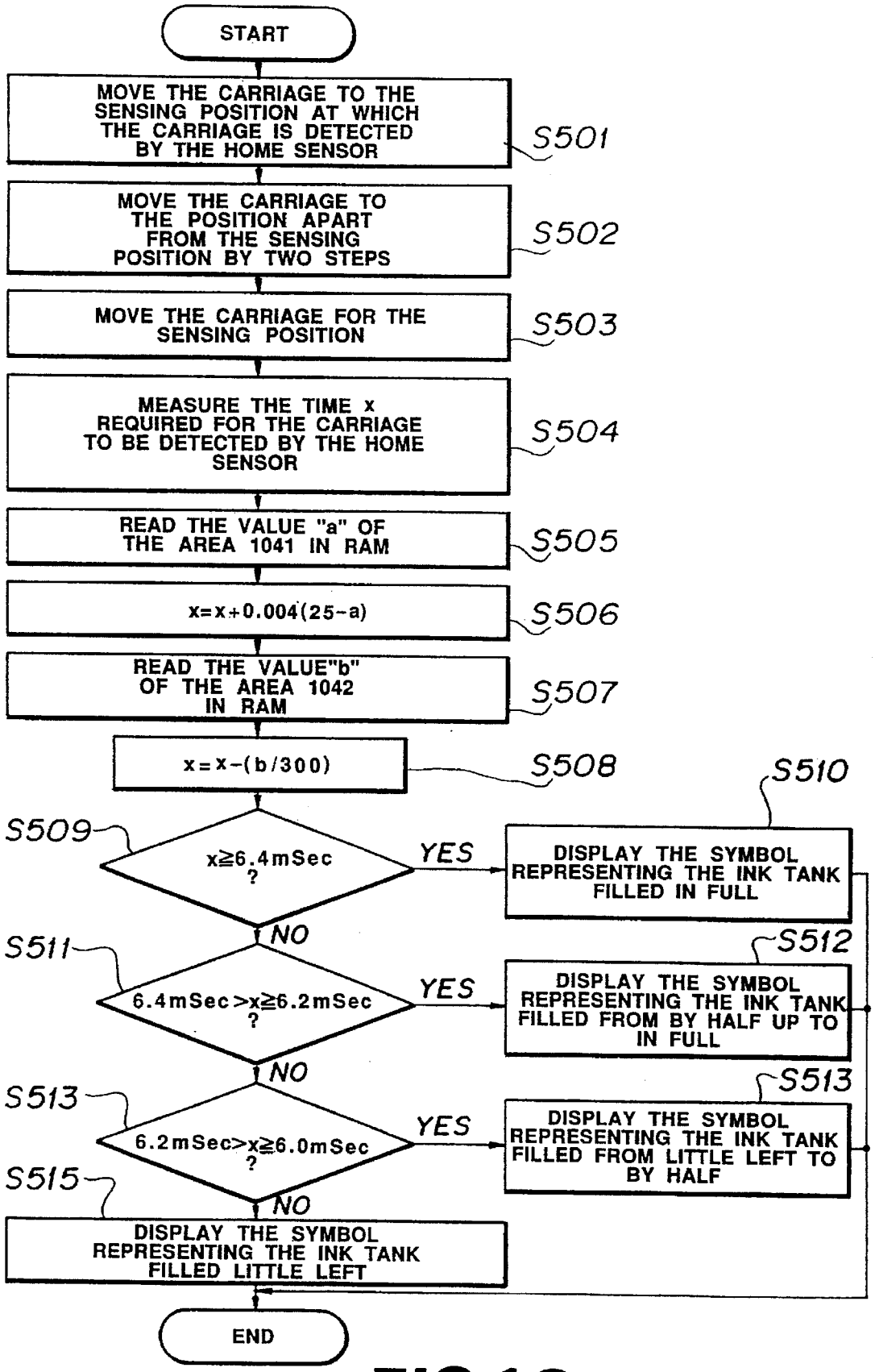
FIG. 16 is a flowchart of an ink amount detecting procedure according to embodiment 5.

So far, after the amount of ink fluids in the ink tank is reported onto the display part, procedures in the flowchart shown in FIG. 16 are completed.

Some modifications of embodiment 5 are described next.

In the above described embodiment 5, the environment correction formulae 1021 is used for correcting the measured time x with respect to the effect of the environmental temperature of the recording apparatus, and the heat generation correction formulae 1022 is used for correcting the measured time x with respect to the effect of the temperature rise of the carriage motor 31 for driving the carriage 11. In contrast, as shown in FIGS. 17 and 18, it may be allowed that both of the correction values are stored in ROM 102 in table form, or that one of the correction value is stored in ROM 102 and the other is determined by the correction formulae, either of which brings the similar effect to that explained with embodiment 5.

In addition, the correction formulae and values are not limited to those generic to embodiment 5 but allowed to be selected arbitrarily, for example, linear or higher order functions of x with their parameters being obtained by parameter fittings.

And furthermore, in case of referring tables, a plurality of tables may be prepared in a hierarchical manner.

In the followings, described are some embodiments extended from the above described embodiments 1 to 5 for further increasing the accuracy in estimating the amount of ink fluids in the ink tank.

(Embodiment 6)

By referring to flowchart shown in FIGS. 19 to 24, procedures related to the detection of the amount of ink fluids in the ink tank with this embodiment 6 are described.

At first, step S601 performs an initialize operation of the ink jet recording apparatus with this embodiment when the electric power supply to the apparatus is turned on by the operator's operation of switches. Next, in step S602, the existence of the recording sheet on the transport route toward the recording position is examined by the output signal from the detection sensor 40.

Figure 23:
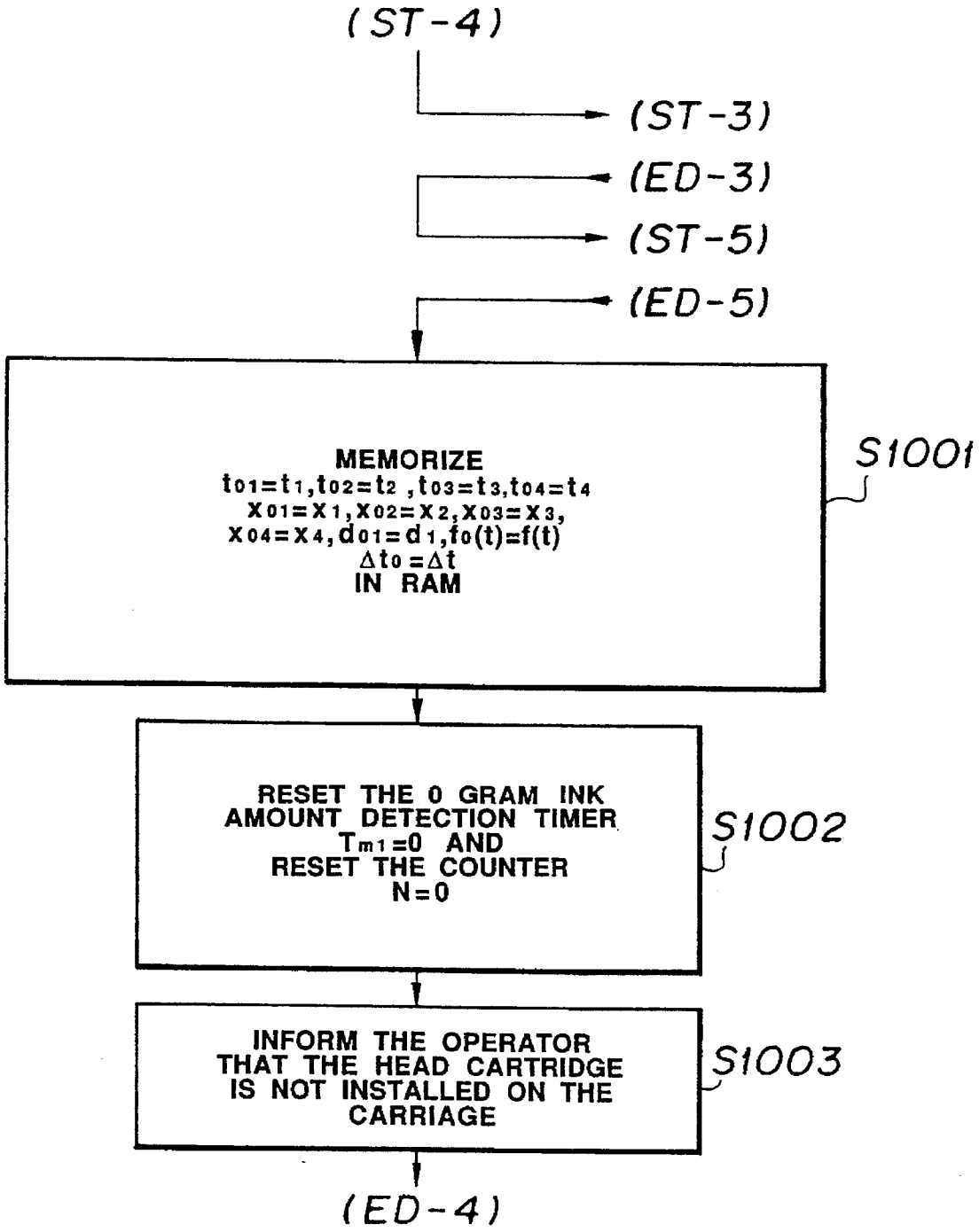
FIG. 23 is a flowchart of a part of an ink amount detecting procedure according to embodiment 6 of the present invention.

In this embodiment, the amount of ink fluids is estimated by the measured time of the carriage 11 movement. In the structure of the recording apparatus with this embodiment, as the surface of the sheet press plate 45 is rubbed with a part of the carriage 11 during the carriage movement, the transportation load of the carriage 11 with a recording sheet being located onto its transport route is greater than that in case that a recording sheet is not located onto the transport route. Thus, the transportation load of the carriage makes an unstable factor for the estimation of the moving time x of the carriage. In this embodiment, the estimation of ink fluids in the ink tank is performed when the recording sheet does not exist on the transport route, which is aimed to increase the accuracy in estimating the amount of ink fluids. In order to realize this, step S602 judges the existence of a recording sheet on its transport route, and if its existence is derived in step S602, the normal recording operation is continued in step S606. At the time when the recording operation is terminated, if a single recording sheet does not exist on the transport route, step S602 reports that there is no recording sheet and step S603 is selected sequentially where judged is whether the cartridge 9 is mounted on the carriage 11. This judgment is examined by detecting the information from electric contacts between the cartridge 9 and the flexible cable 21, for example, detecting the electric resistance. In case that step S603 judges that the cartridge is not mounted, procedures for detecting the amount of residual ink fluids, called "zero gram ink amount detection procedures" with its flowchart shown in FIG. 23 are invoked. Procedures for detecting residual grams shown in FIG. 23 are described below.

Figure 22:
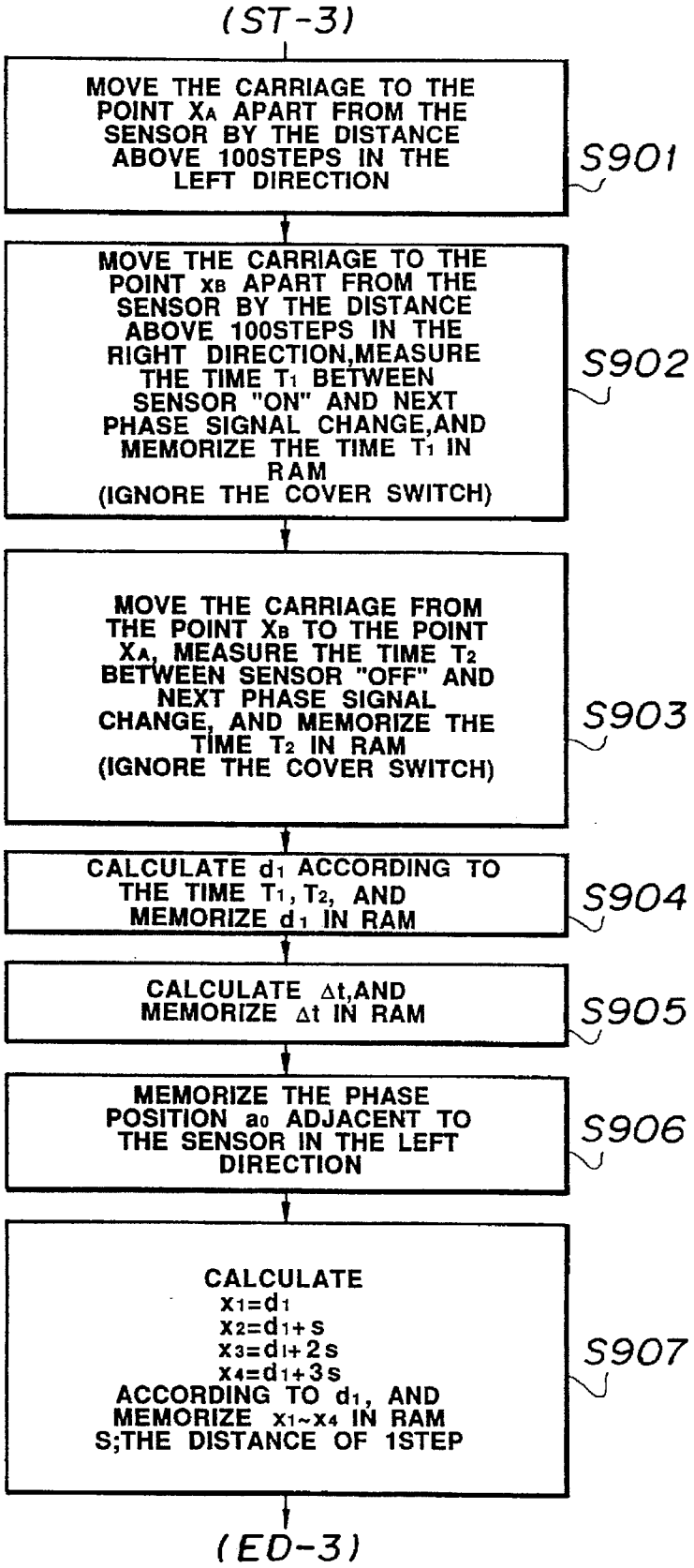
FIG. 22 is a flowchart of a part of an ink amount detecting procedure according to embodiment 6 of the present invention.

In FIG. 23, when a sequence of procedures of the flowchart shown in FIG. 23 is started, at first, the procedures with its flowchart being shown in FIG. 22 are invoked for detecting the position of the home sensor in the case that the cartridge 9 is not mounted. In FIG. 22, at first, in step S901, the carriage 11 is made to be located in the position in a sufficiently long distance from the home sensor 64, for example, a position designated by $X_A$ in a distance equivalent to 100 unit steps left side from the home sensor 64, so that the carriage 11 may pass through the home sensor in a uniform velocity. Next, in step S902, the carriage 11 is made to move through the sensor 64 in a uniform velocity and to be fixed in the position designated by $X_B$ in a distance equivalent to 100 unit steps right side from the sensor 64. This movement of the carriage from $X_A$ to $X_B$ is called "tab movement". At the same time, in step S902, measured is the time $T_1$ passed since the sensor 64 is turned on until the next phase signal to the carriage motor 31 rises up.

Figure 25:
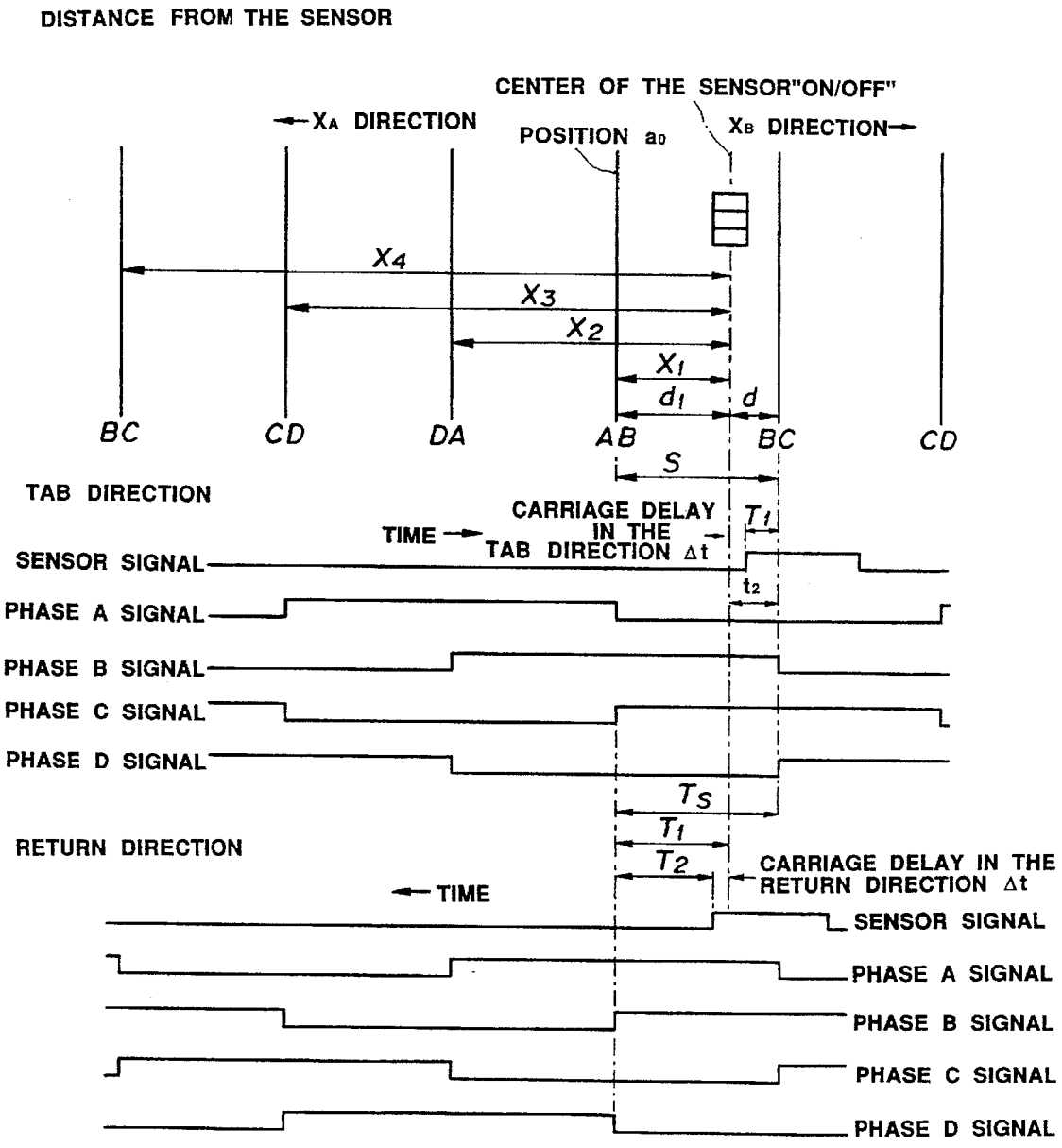
FIG. 25 is a diagram illustrating the relation between a carriage position in an ink amount procedure and an exciting signal to a carriage motor in embodiment 6.

In this measurement of $T_1$, as apparent from the timing chart for the tab-movement direction shown in FIG. 25, for example, $T_1$ is defined as the period of time between the time when the sensor 64 is turned on while the B, C phase of the carriage motor 31 is excited and the time when the next excitation for D phase. Next, in step S903, the carriage is moved from the position $X_B$ to the position $X_A$ in "return movement", and at the same time, the period of time $T_2$ between the time when the sensor 64 is turned off and the time when the next excitation for a pertinent phase of the carriage motor 31. As apparent from the timing chart for the return-movement direction shown in FIG. 25, for example, $T_2$ is defined as the period of time between the time when the sensor 64 is turned off while the A, B phase of the carriage motor 31 is excited and the time when the next excitation for D phase. In representing the phase change as shown in FIG. 25 for the detection by the sensor 64, the sensor 64 is located between the A, B phase and the B, C phase.

The delay time, designated by Δt, with respect to the reach phase of the carriage 11, where the positive direction of Δt is designated by the time direction in which the carriage move, is given by $$\Delta t=(T_s-T_2-T_1)/2,$$

where $T_s$ is the time period for the phase signal between a couple of its adjacent rise times or its adjacent fall times.

The above equation is derived from the following equations, $$t_1+t_2=T_s,$$

$$d_1+d_2=s,$$

$$d_1/t_1=d_2/t_2,$$

$$t_2=T_1+\Delta t, \text{ and}$$

$$t_1=T_2+\Delta t,$$

all of which are reduced into the following equation, $$d_1=s(T_s+T_2-T_1)/2T_s,$$

in which

- s is the distance of the movement of the carriage in the period $T_s$,
- $d_1$ is the distance from the position of the carriage corresponding to the A, B phase to the position of the sensor 64,
- $d_2$ is the distance from the position of the sensor 64 to the position of the carriage corresponding to the B, C phase, and
- $t_1$ and $t_2$ are the period time spent for the carriage moving in the distance $d_1$ and d2, respectively.

As $T_1$ and $T_2$ must be measured in high accuracy, another interruptive process of software such as watching the cover switch is made to be excluded in steps S902 and S903. In steps S904 and S905, $d_1$ and Δt are calculated by the above equations and stored in RAM 104. In addition, in step S906, stored is the position a0 of the carriage 11 corresponding to the phase adjacent left to the sensor 64, the A, B phase in this embodiment. Next, in step S907, the moving distance $x_1$ to $x_4$ of the carriage 11 as defined in FIG. 25, which are used for the four-point data sampling procedures shown in FIG. 24, are calculated and stored.

Figure 24:
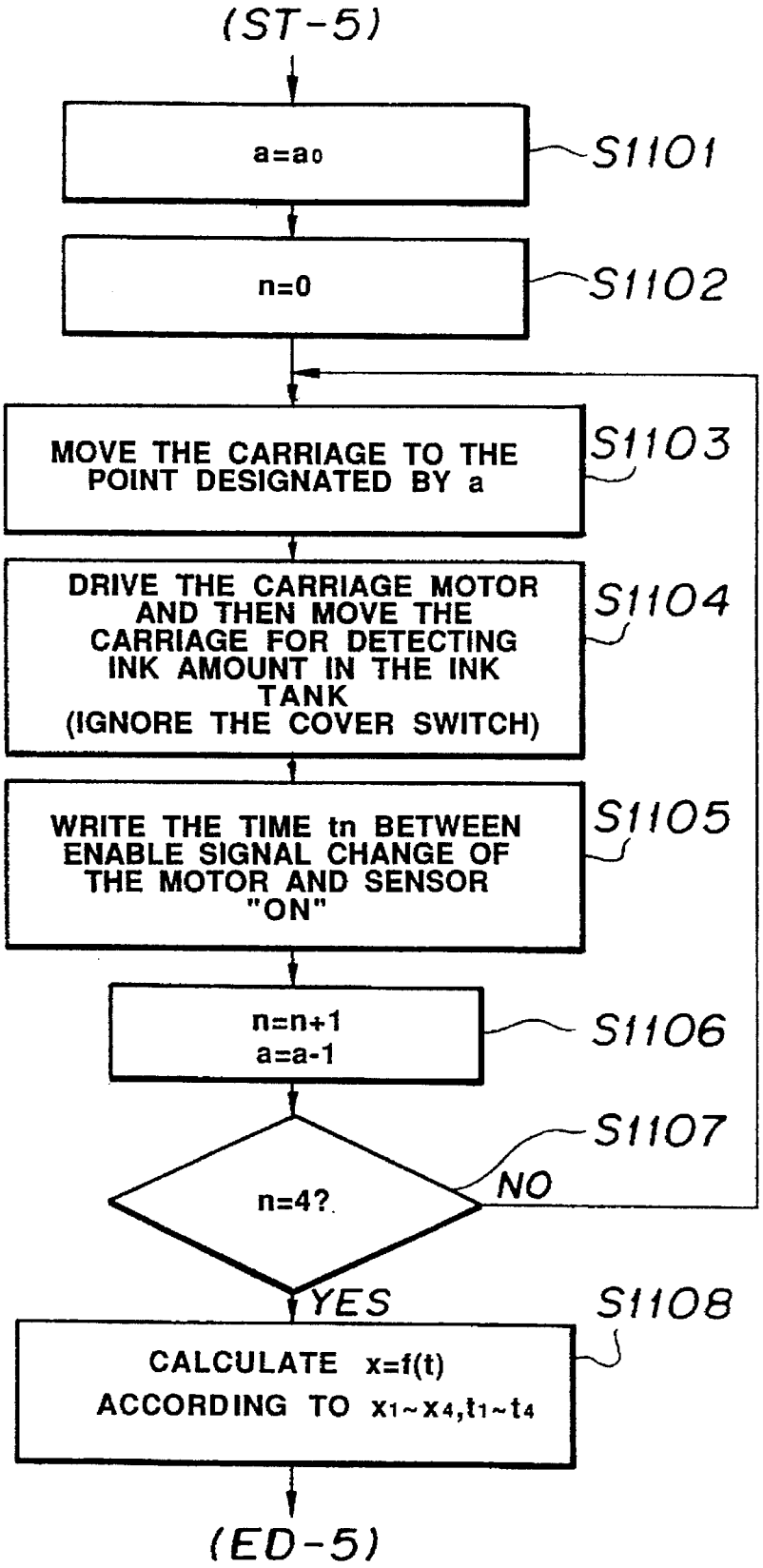
FIG. 24 is a flowchart of a part of an ink amount detecting procedure according to embodiment 6 of the present invention.

After procedure shown in FIG. 22 are completed, the program control is returned temporarily to the procedure shown in FIG. 23 and immediately, procedures shown in FIG. 24 are invoked.

At the beginning of procedures in FIG. 24, in step S1101, the position a0 of the carriage in a distance $x_1$ from the sensor 64 as defined in FIG. 25 is transferred into the register "a" for storing the position for starting the measurement of the amount of ink fluids. Next, in step S1102, the counter "n" for storing the point of measuring the amount of ink fluids is reset to be zero. Next, in step S1103, the carriage 11 is moved to the position specified by "a", and in step S1104, the carriage 11 is moved acceleratively from the position "a" toward the sensor 64. In step S1105, the period $t_1$ between the time when the start signal of the carriage 11 is issued and the time when the sensor 64 detects the carriage 11 is captured in RAM 104. In step S1104, similarly to previously described steps S902 and S903, another interruptive process is excluded.

Next, in steps S1106 and S1107, n and "a" are incremented. Thus, steps S1103 through S1106 are repeated until n reaches 4 which is judged in step S1107, where the time $t_2$, $t_3$ and $t_4$ corresponding to $x_2$, $x_3$ and $x_4$ are obtained. Finally, in step S1108, by analyzing a correlation between $x_1$ to $x_4$ and $t_1$ to $t_4$, "x" is defined as a function of the second order of "t", that is, $$x=f(t),$$

before the program control goes back to procedures shown in FIG. 23.

In step S1001 of the procedures shown in FIG. 23, $x_1$ to $x_4$, $t_1$ to $t_4$, $d_1$, f(t) and $\Delta t$, all obtained in the above procedures, are stored in RAM 104 as data when the cartridge 9 is not mounted on the carriage 11. Next, in step S1002, the timer for "zero gram ink amount detection", $Tm_1$, and the counter for the number of characters recorded, N, are reset. The timer $Tm_1$ and the counter N are used as a reference for judging whether the data, $x_{01}$ to $x_{04}$, $t_{01}$ to $t_{04}$, $d_{01}$, $f_0$ (t) and $\Delta t_0$, are newly revised with respect to time series or recording times. The timer $Tm_1$ is synchronized with the clock signal of CPU 100 and incremented constantly after reset. The counter N is constantly incremented as the cumulative number of recorded characters. Next, in step S1003, a message is issued to the operator for notifying that the head cartridge 9 is not mounted on the carriage. As for the way of reporting this message to the operator, it may be possible to use a buzzer or a visual display.

Figure 19:
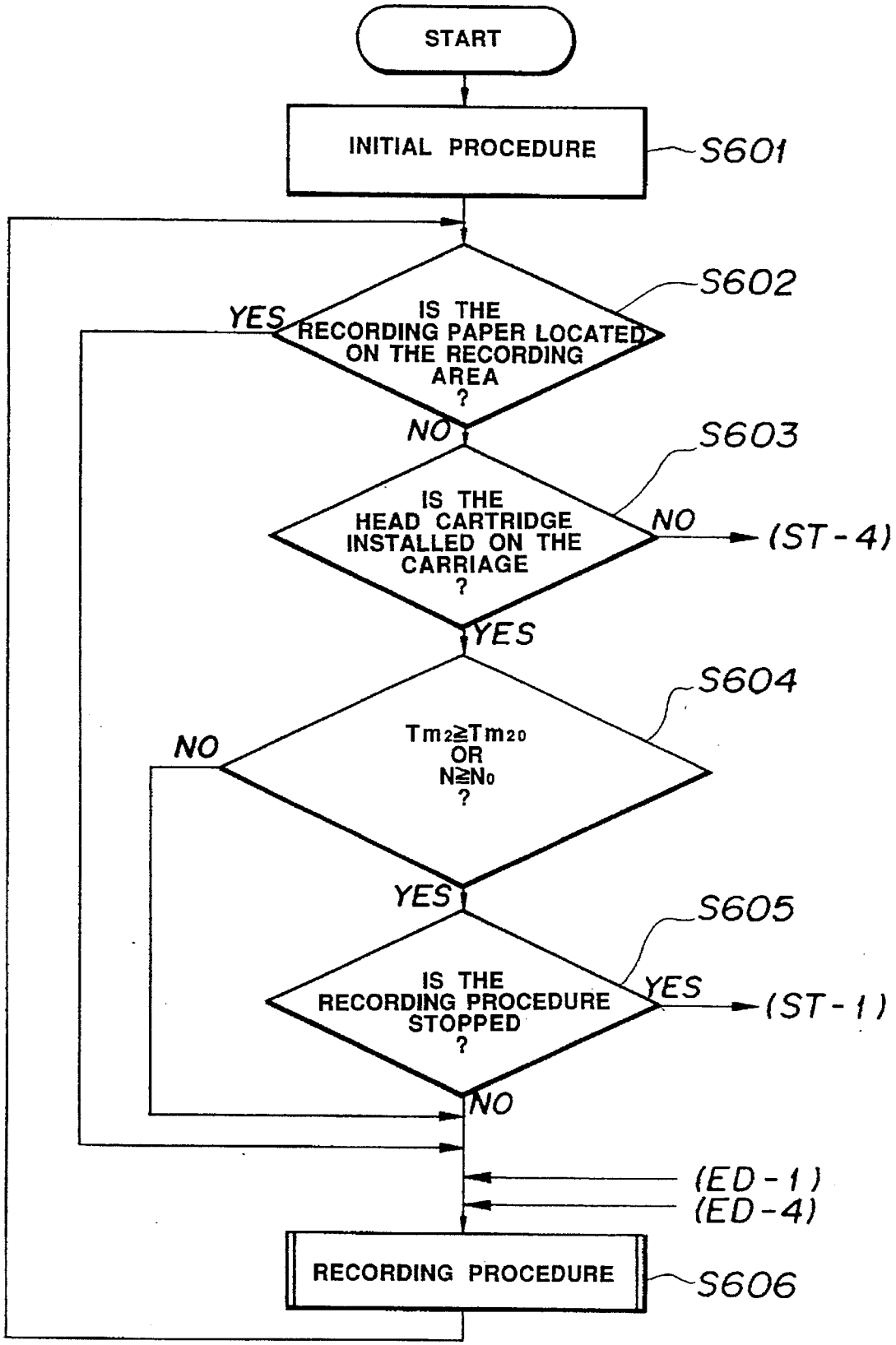

After "zero gram ink amount detection procedures" shown in FIG. 23 are completed, recording operations are performed in step S606 shown in FIG. 19, and step S602 is called back.

The procedures described above relate to the case where step S603 judges that the head cartridge 9 is not mounted.

On the other hand, in case that step S603 judges that the head cartridge 9 is mounted, in step S604, judged is whether the time comes for performing ink amount detection procedures by examining the timer $Tm_2$ and the counter N. If step S604 judges that the ink amount detection procedures are not still necessary, step S606 is selected where recording operations are continued. If step S604 judges that the ink amount detection procedures are necessary, the state of the recording apparatus with this embodiment is examined in step S605. That is, judged is whether the recording apparatus is not in use, more specifically, the recording head on the carriage 11 is capped at the home position. If the recording apparatus is operated in use, the termination of recording operations performed in step S606 is watched by step S605. When step S605 detects that the recording apparatus is not in use for recording operations, procedures for detecting the amount of ink fluids, called "main ink amount detection procedures", shown in FIG. 20, are called.

Figure 20:
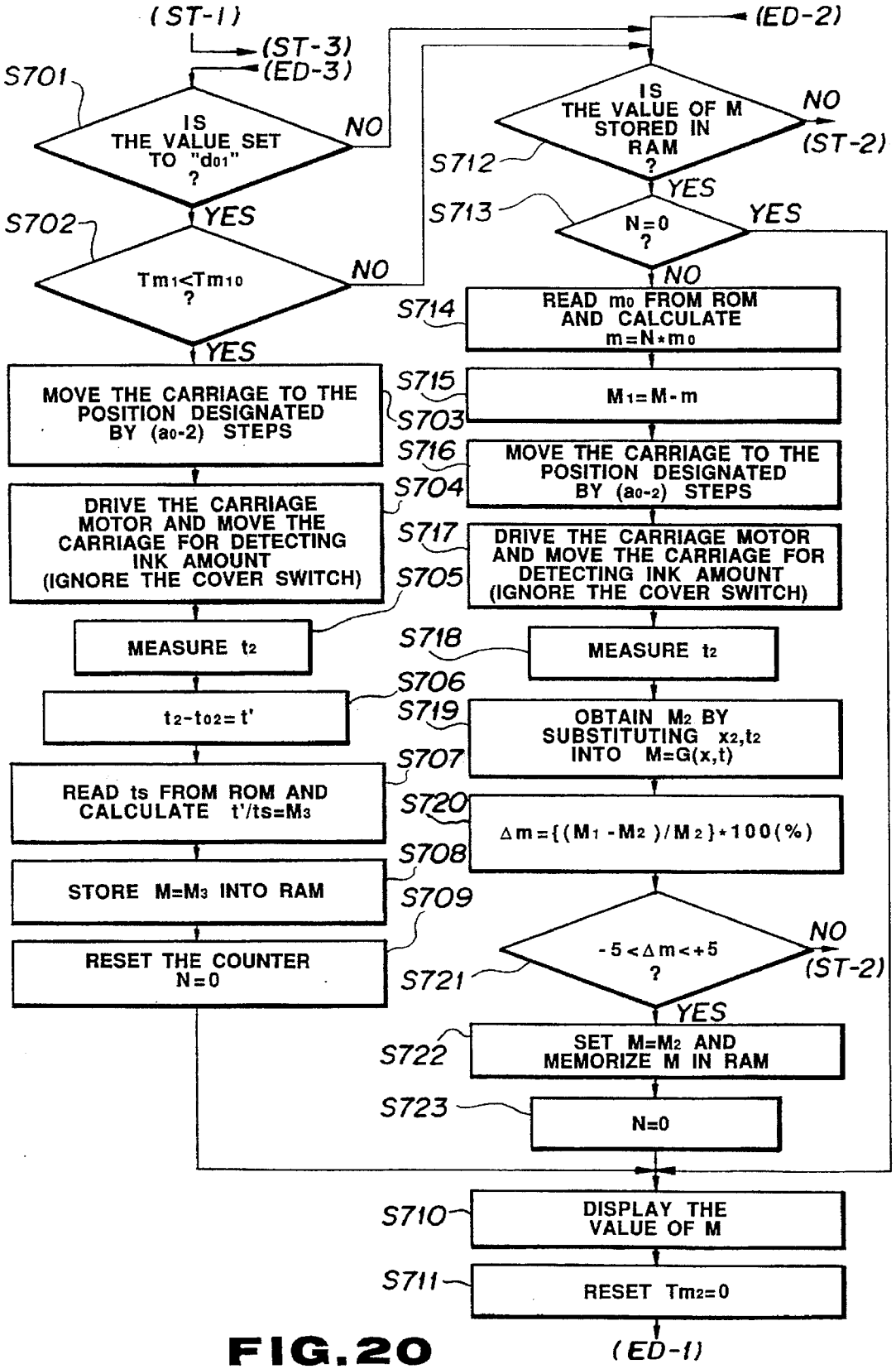
FIG. 20 is a flowchart of a part of an ink amount detecting procedure according to embodiment 6 of the present invention.

In procedures in FIG. 20, at first, procedures for detecting the position of the sensor as described by referring to FIG. 22 are performed by steps S901 to S907 where $x_1$ to $x_4$ are newly obtained. Next, in step S701, the existence of data for "zero gram ink amount detection procedures" is examined by judging whether a value is assigned to the memory area for $d_{01}$ in RAM in procedures shown in FIG. 23. If these data exist and it is judged in step S702 that these data are not old with respect to time series and recording times, steps S703 to S709 are executed. These steps S703 to S709 detect the amount of ink fluids by using updated data prepared for "zero gram ink amount detection procedures" stored in RAM at step S1001 in FIG. 23 as reference values.

On the other hand, in case that it is judged in step S701 that there are no data for "zero gram ink amount detection procedures" or in step S702 that these data are not revised for the current situation, steps S712 to S723 are executed. These steps S712 to 723 detect the amount of ink fluids by using the old value for M as a reference value.

At first, procedures by steps S703 to S709 are described.

In step S702, data for "zero gram ink amount detection procedures" are judged not to be old, data sampling is performed in steps S703 to S705 where data at a single point, at $t_2$ in this embodiment, are sampled instead of all the four points as in the procedures shown in FIG. 24. The reason is to reduce the time for detecting the amount of ink fluids. In step S704, another interruptive process such as handling of signals from cover switch is excluded as described earlier.

After the above procedures for sampling data, the value $t_{02}$ at "zero gram ink amount detection procedures" and the sampled value $t_2$ are compared in step S706, and the time difference t' between them is calculated. In step S707, the time shift $t_s$ representing the period of time corresponding to the change of weight of the carriage 11 by 1 gram, that is, "sensitivity", which is previously defined in ROM 102, is read-out, and the weight of the head cartridge 9 mounted on the carriage, M3, is calculated with the time shift, $t_s$, and the time difference, t' with the equation $M_3=t'/t_s$. In step S708, the calculated value of M3 is defined as the estimated amount of ink fluids M. In step S709, the counter N is reset for preparing the next chance for detecting the amount of ink fluids.

Next, procedures by steps S712 to S723 are described.

Figure 21:
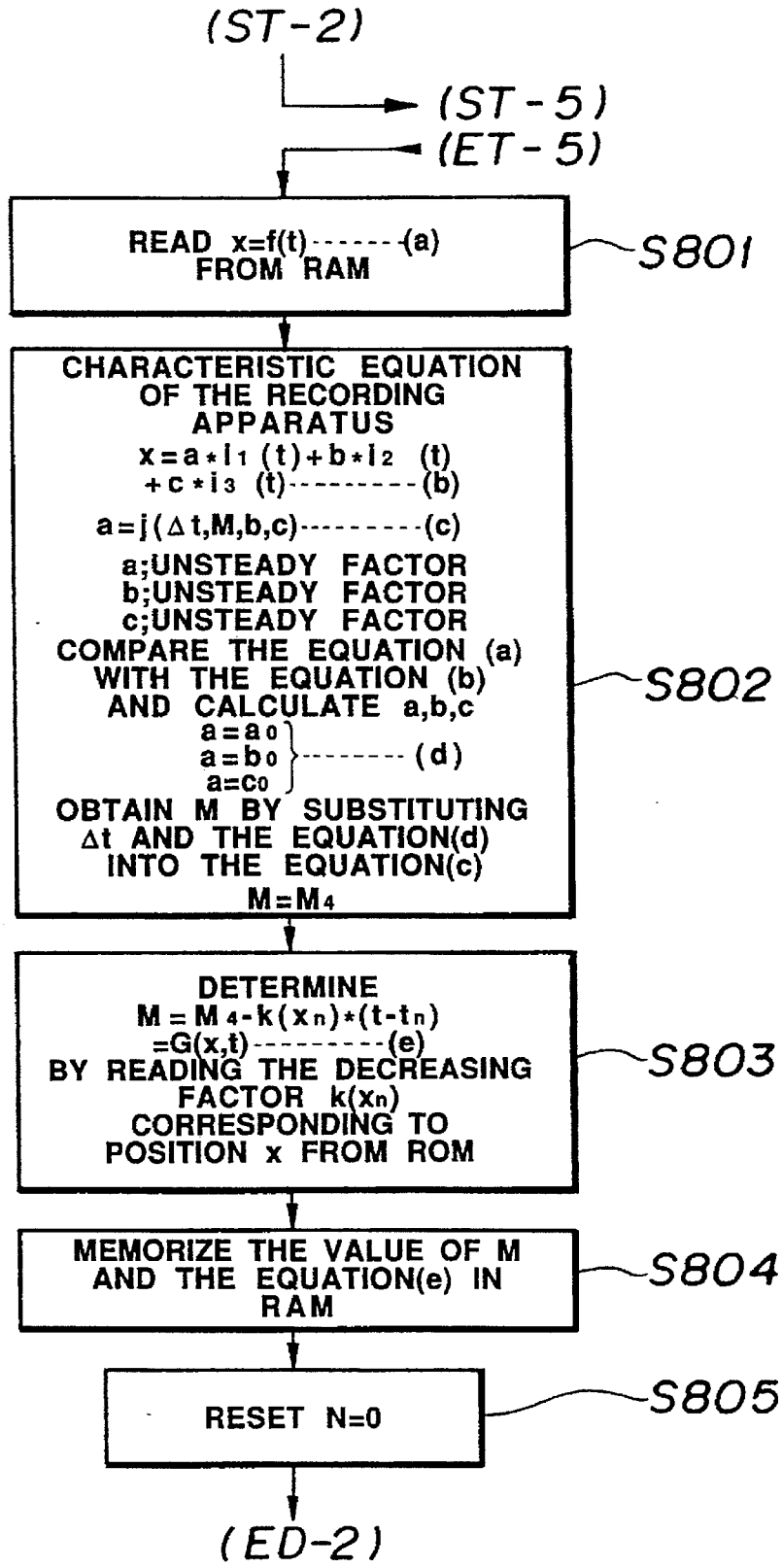
FIG. 21 is a flowchart of a part of an ink amount detecting procedure according to embodiment 6 of the present invention.

In step S712, judged is whether the previous value M exists in order to be used as a reference value for this time. If there is no previous value M in RAM, "ink amount detection procedures-in-detail" shown in FIG. 21 are called. At first in procedures in FIG. 21, steps S1101 to S1108 are executed for four-point sampling procedures shown in FIG. 24, and the program control is returned to step S801 of "ink amount detection procedures-in-detail" in FIG. 21. In step S801, the function of second order obtained experimentally in the four-point sampling procedures, $$x=f(t) \quad \text{(a)},$$

is read-out from RAM 104.

Next, in step S802, the previously obtained correlation function generic to the recording apparatus with this embodiment, with respect to x, t, M and $\Delta t$, $$x=a*i_1(t)+b*i_2(t)+c*i_3(t), \quad \text{(b)}$$

and $$a=j(\Delta t, M, b, c) \quad \text{(c)}$$

are read-out from R0M 102, and by comparing coefficients in equations (a) and (b), values for the unstable factor parameters a, b and c are calculated to be $$a=a_0,\ b=b_0\ \text{and}\ c=c_0.$$

M is estimated by substituting $a_0$, $b_0$, $c_0$ and $\Delta t$ into the equation (c) as in $$M=M_4,$$

where $M_4$ is measured by grams, $i_1(t)$ and $i_2(t)$ are the second order functions of "t", $i_3(t)$ is the first order function of "t", and the equation (c) is represented by the second order equation of M and $\Delta t$ and by the first order equation of b and C.

Next, in step S803, by using the estimated value $M_4$ for the amount of ink fluids, an approximation formulae for calculating the amount of ink fluids around $M_4$ is derived.

The decreasing coefficient k ($x_n$), measured in g/μs, previously stored in ROM 102, and depending upon the position X of the carriage 11, which is determined by the positions $x_1$~$x_4$ respectively, that is, which is read out from ROM102 in accordance with the value n of $x_n$, is read-out and the linear interpolation formulae is formed as in $$M = M_4 - k(xn) * (t - tn), \text{ or}$$
$$= G(x,t) \qquad -(e).$$

Next, in step S804, the value of $M_4$ and the formulae (e) are stored in RAM 104. In step S805, the counter N is reset as in N=0, and immediately going back to procedures in FIG. 20 and after steps S712 and S713, step S710 is selected where M is displayed as the amount of ink fluids in the ink tank.

On the other hand, in case that step S712 judges that the value M obtained in the previous ink amount detection procedures exists and that step S713 judges that the counter N for the number of recorded characters is greater than zero and hence that recording operations are continued after the previous procedures for detecting the amount of ink fluids, the amount of ink fluids, m measured in gram, having been used since the previous time of the ink amount detection procedures is estimated by the formulae $N*m_0$, where $m_0$ is the amount of ink fluids consumed by recording a single character, measured in gram/character and stored in ROM102. In step S715, the overall amount of ink fluids, $M_1$, is estimated as in $M_1=M-m$.

Next, in steps S716 to S718, data sampling is performed where data at a single point, at $t_2$ in this embodiment, are sampled for measuring the amount of ink fluids. In step S717, another interruptive process such as signals from cover switch is excluded similarly in step S704. In step S719, by using the correlation formulae for M such as M=G (x, t) defined in the previous ink amount detection procedures and substituting $x_2$ and $t_2$ into this formula, the amount of ink fluids at this time is estimated as $M_2$. In step S720, by examining the error between the calculated value $M_2$ and the estimated value $M_1$, in case that the error is within ±5%, the calculated amount $M_2$ of ink fluids to be taken as a result is made to be $M_2$ in step S722, and finally in step S723, the counter N is reset to be zero, which is followed by steps S710 and after. On the other hand, if step S721 judges the error between $M_2$ and $M_1$ does not remain within ±5%, "ink amount detection procedures-in-detail" shown in FIG. 21 are executed again for refining the value of M.

As described above, the estimated value M in steps S708 and S722 in FIG. 20, and step S804 in FIG. 21, is displayed on the display part 6. At this time, it may allowed that the displayed value is the net weight of ink fluids, M', by subtracting the weight of the empty cartridge, $M_0$, from the estimated gross weight of ink fluids, M, as in $M'=M-M_0$. In the final step S711 in FIG. 20, $Tm_2$ is reset to be zero so as to prepare the condition for the next ink amount detection procedures, and finally, step S606 in FIG. 19 is called back for continuing the recording operations, and thus the ink amount detection procedures are terminated.

In the above described steps S717, S704, S1104, S902 and S903, any interruptive process such as judging the status of the cover switch is prohibited and excluded in order to reduce the time spent in doing procedures. In case that the movement of carriage during procedures in these steps may be interrupted by opening the cover of the apparatus, which leads consequently to the reduction of the accuracy in estimating the amount of ink fluids. In order to solve this problem, the state of the cover switch is examined before and after each step mentioned above, and in case that the cover is opened, the step before the interrupted step is called back again.

In addition, in "ink amount detection procedures-in-detail" shown in FIG. 21, four-point sampling procedures are performed and the value of M and the correlation formulae (e), that is, $$M=G(x, t)$$

is obtained.

Figure 26:
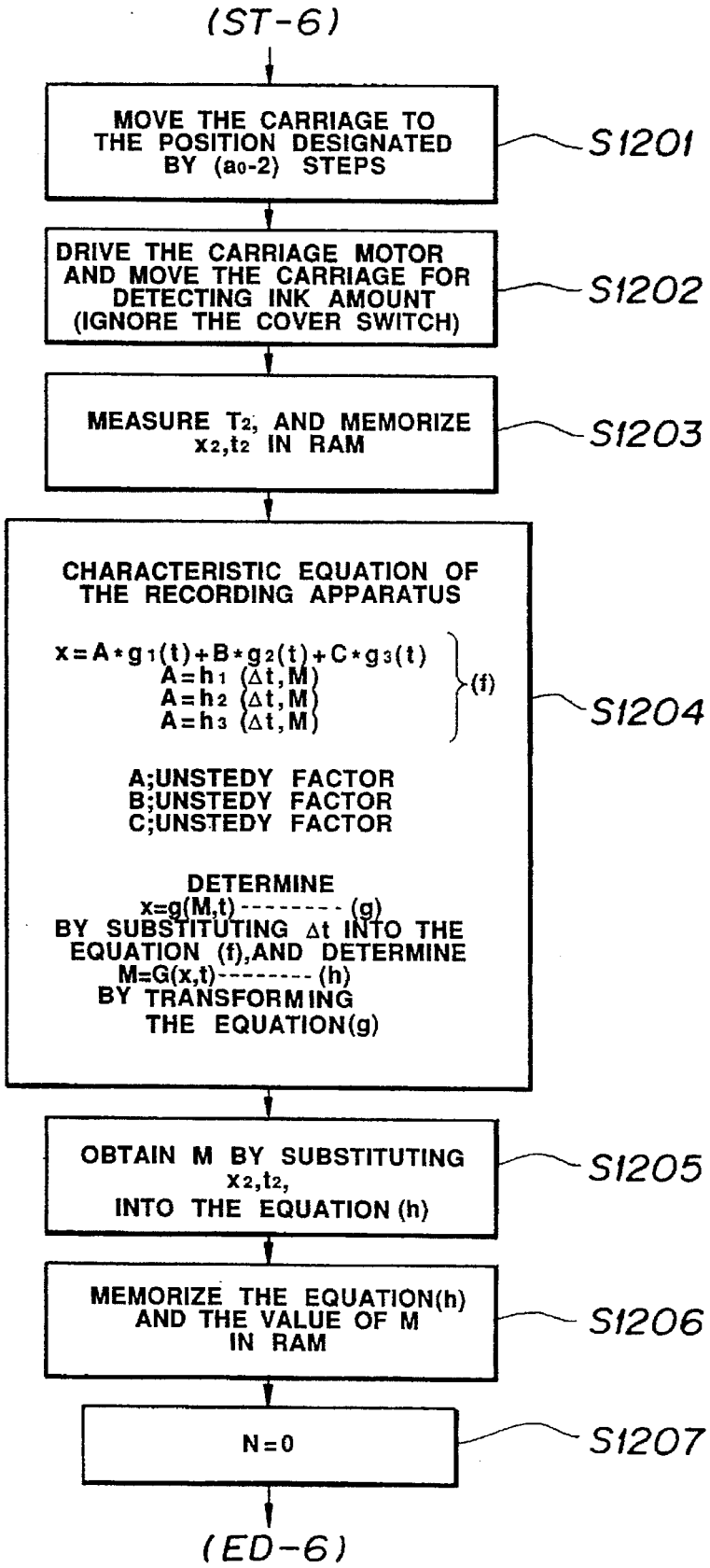
FIG. 26 is a flowchart of a part of an ink amount detecting procedure according to a modification of embodiment 6.

Instead, as shown in procedures of the flowchart in FIG. 26, with a single point sampling, the value of M and a correlation formula equivalent to the formula (e) can be obtained.

Procedures shown in FIG. 26 are described below. At the beginning of the procedures in FIG. 26, in steps S1201 to S1203, the value of $t_2$ is obtained. Next in step S1204, by using the correlation formula (f) which gives more accurate estimation scheme than formulae given by (b) and (c) in step S802 in FIG. 21, it is possible to define previously the formula (h) equivalent to the formula (e) in contrast to the case using the procedure in step S802. In this case, the formula (h) can be obtained only by calculating Δt, and hence, in step S1205, the value of M can be determined. Procedures in steps S1206 and S1207 are similar to those in steps S804 and S805 shown in FIG. 21.

And furthermore, in this embodiment, as shown in FIG. 2, an interrupt-type sensor is used as the home sensor 64, and in steps S901 to S906, the position of the home sensor 64 is detected. The characteristics of this type of sensor with respect to rise-up and fall-down response may be often changed during a long term usage of the sensor. In such a case, the accuracy of the estimated position of the sensor, $d_1$, is reduced and hence, the accuracy of the estimated amount of ink fluids may be reduced. In order to solve this problem, what can be added to the procedures generic to this embodiment is such an additive step as described below; after the initialization by step S601 in FIG. 19, the power supply to the sensor 64 is shut down except the initialization by the reset signal from the cover switch which is one of recording operations in step S606, and the power supply to the sensor 64 is turned on only when the procedures for detecting the amount of ink fluids as shown in FIGS. 20 and 23. With this additive step for switching the power supply to the sensor, it will be appreciated to prevent the reduction of the accuracy in estimating the amount of ink fluids due to the degradation of the sensor.

And furthermore, "zero gram ink amount detection procedures" shown in FIG. 23 are not executed as far as the operator does not forget to mount the head cartridge with an ink tank into the recording apparatus. However, data stored in RAM 104 in step 1001 are important for representing operational characteristics of the carriage 11, and may effect the accuracy of the estimation of the amount of ink fluids. It may be possible to form ROM 102 shown in FIG. 3 in the form of EEP-ROM and to store data, which is to be recorded by step S1001 when operating the recording apparatus, into EEP-ROM in each apparatus when fabricating them. Owing to this, the accuracy of estimating the amount of ink fluids can be certainly increased.

In the above described embodiments 1 to 6, what is described is that the amount of ink fluids in the ink tank is estimated by the period of time during which the carriage having the ink tank travels in a designated distance, that is, its average velocity in the designated distance.

In the following embodiment 7, what is explained is that the judgment on whether the ink tank is replaced for new one, being based on the detected of ink fluids.

(Embodiment 7)

In this embodiment, by using the procedures for detecting the amount of ink fluids with embodiment 6 described above, the detection for whether the head cartridge having an ink tank in it as shown in FIG. 2 is performed. That is, the detection of the amount of ink fluids is repeated in a designated time interval, and by comparing the detected amount of ink fluids in adjacent intervals and judging the change rate of the amount of ink fluids in time. If the change rate of the amount of ink fluids is greater than a designate value, it is concluded that the head cartridge is replaced to new one in the time interval between a couple of adjacent operations of detecting the amount of ink fluids.

Figure 27:
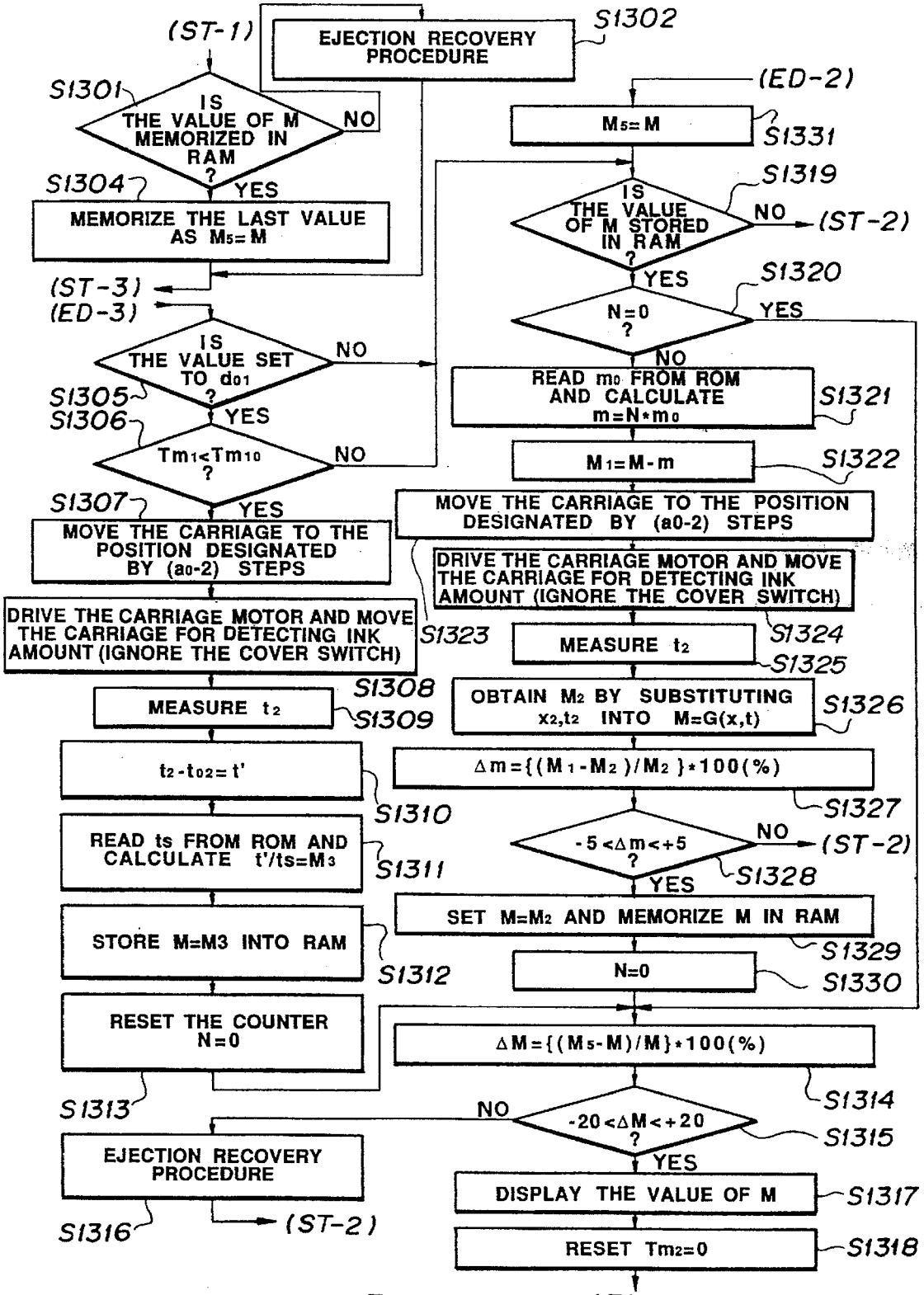
FIG. 27 is a flowchart showing an ink amount detecting procedure and a head cartridge exchange detecting procedure according to embodiment 7 of the present invention.

In this embodiment, performed are procedures similar to those shown in FIGS. 19 to 24 with embodiment 6. The distinctive procedures generic to this embodiment 7 are a part of procedures shown in FIG. 20, which are shown in FIG. 27 respectively. The overall procedures with this embodiment 7 are found in FIGS. 19 and 27, and FIGS. 21 to 24.

In the followings, referring to FIG. 27 mainly, embodiment 7 is described.

In case that step S605 shown in FIG. 19 judges that the printer is not in use for recording operations, "main ink amount detection procedures" shown in FIG. 27 are called. In procedures in FIG. 27, at first, in step S1301, examined is whether the previous value of the estimated amount of ink fluids in the previous time is stored in RAM 104. The procedure in step S1301 means that, as the state of the recording head and the ink tank of the installed head cartridge is often unknown or indefinite especially when the operator initially uses the recording apparatus and the content of RAM 104 has been lost due to the loss of charge in the batteries for the back-up of RAM 104, it is aimed that the sucking restoration operation is temporarily performed for the next recording operations in the nearest future. That is, shortly, if it is judged that the value of the estimated amount of ink fluids is not found on RAM 104, the sucking restoration operation is performed onto the recording head at the home position.

In an ordinary case, step S1301 determines that the previous value of the estimated amount of ink fluids in the previous time is alive in RAM 104 and, in step S1304, this value is stored as a reference used for the next estimation. Next, the position of the sensor is detected in a series of steps S901 to S907 shown in FIG. 22 where $x_1$ to $x_4$ are newly obtained.

Next, in step S1305, the existence of the value obtained by "zero gram ink amount detection procedures" is judged in step S1350 by examining whether the content of the memory area corresponding to $d0_1$ exists. If the value of "$d0_1$" exists and it is new with respect to time series and recording numbers, procedures in steps S1307 to S1313 are performed next. If step S1305 judges that the value of "$d0_1$" has been lost or step S1306 judges that the data of "$d0_1$" are old and inconsistent with the current state of the recording apparatus, procedures in steps S1319 to S1330 are performed. As the procedures in steps S1307 to S1313 and steps S1319 to S1330 are identical to those in steps S703 to S709 and steps S712 to S723, respectively, the explanation of these procedures is eliminated here.

When the new value of the estimated amount M of ink fluids is determined by procedures in steps S1307 to S1313 or steps S1319 to S1330, procedures for detecting the exchange state of the ink tank are executed from step S1314. In step S1314, the change rate ΔM in the amount of ink fluids is calculated from the previous value $M_5$ and the present value M with respect to the estimated amount of ink fluids. If step S1315 judges that the change rate ΔM is 20% or more, or −20% or less, that is, outside ±20%, and hence, that the cartridge has been replaced, and consequently, in step S1316, the sucking restoration operation is performed for the recording head of the cartridge newly mounted, and then, "ink amount detection procedures-in-detail" shown in FIG. 21 are next executed for determining the value of M.

If step S1315 judges that the change rate ΔM is within ±20%, and hence, that the cartridge has not been replaced, and consequently, procedures after step S1317 are executed for displaying a pertinent message where the estimated amount of ink fluids, M, is displayed on the display part 6 in step S1317. In displaying the information, it may be allowed that the net weight of ink fluids, M', is displayed on the display part by subtracting the weight of the empty ink cartridge, $M_0$ which is referenced from ROM 102, from the overall weight of ink fluids, M, as in $M'=M-M_0$. In step S1318, the timer $Tm_2$ is reset to be zero for preparing the next estimation operation, and finally in step S606 of FIG. 19, the recording operations are continued.

In the above described embodiment, in step S1315, the reference value to the change rate for judging the necessity of the sucking restoration operation is made to be −20% and 20%. As the amount of ink fluids required for the sucking restoration operation is larger than that for the ejection restoration operation and the wiping operation, an adequate restoration operation may be selected by classifying the change rate in more fine levels. For example, in steps S1315 and S1316, in case that the change rate is between 5% and 10% or between −5% and −10%, the wiping restoration operation is selected, and in case that the change rate is between 10% and 20% or between −10% and −20%, the ejection restoration operation is used, and in case that the change rate is outside ±20%, the sucking restoration ejection is executed. This way of selection of restoration methods may result in the reduction of wasted ink fluids not effectively used.

The present invention achieves distinct effect when applied to a recording head or a recording apparatus which has means for generating thermal energy such as electrothermal transducers or laser light, and which causes changes in ink by the thermal energy so as to eject ink. This is because such a system can achieve a high density and high resolution recording.

A typical structure and operational principle thereof is disclosed in U.S. Pat. Nos. 4,723,129 and 4,740,796, and it is preferable to use this basic principle to implement such a system. Although this system can be applied either to on-demand type or continuous type ink jet recording systems, it is particularly suitable for the on-demand type apparatus. This is because the on-demand type apparatus has electrothermal transducers, each disposed on a sheet or liquid passage that retains liquid (ink), and operates as follows: first, one or more drive signals are applied to the electrothermal transducers to cause thermal energy corresponding to recording information; second, the thermal energy induces sudden temperature rise that exceeds the nucleate boiling so as to cause the film boiling on heating portions of the recording head; and third, bubbles are grown in the liquid (ink) corresponding to the drive signals. By using the growth and collapse of the bubbles, the ink is expelled from at least one of the ink ejection orifices of the head to form one or more ink drops. The drive signal in the form of a pulse is preferable because the growth and collapse of the bubbles can be achieved instantaneously and suitably by this form of drive signal. As a drive signal in the form of a pulse, those described in U.S. Pat. Nos. 4,463,359 and 4,345,262 are preferable. In addition, it is preferable that the rate of temperature rise of the heating portions described in U.S. Pat. No. 4,313,124 be adopted to achieve better recording.

U.S. Pat. Nos. 4,558,333 and 4,459,600 disclose the following structure of a recording head, which is incorporated to the present invention: this structure includes heating portions disposed on bent portions in addition to a combination of the ejection orifices, liquid passages and the electrothermal transducers disclosed in the above patents. Moreover, the present invention can be applied to structures disclosed in Japanese Patent Application Laying-open Nos. 123670/1984 and 138461/1984 in order to achieve similar effects. The former discloses a structure in which a slit common to all the electrothermal transducers is used as ejection orifices of the electrothermal transducers, and the latter discloses a structure in which openings for absorbing pressure waves caused by thermal energy are formed corresponding to the ejection orifices. Thus, irrespective of the type of the recording head, the present invention can achieve recording positively and effectively.

In addition, the present invention can be applied to various serial type recording heads: a recording head fixed to the main assembly of a recording apparatus; a conveniently replaceable chip type recording head which, when loaded on the main assembly of a recording apparatus, is electrically connected to the main assembly, and is supplied with ink therefrom; and a cartridge type recording head integrally including an ink reservoir.

It is further preferable to add a recovery system, or a preliminary auxiliary system for a recording head as a constituent of the recording apparatus because they serve to make the effect of the present invention more reliable. As examples of the recovery system, are a capping means and a cleaning means for the recording head, and a pressure or suction means for the recording head. As examples of the preliminary auxiliary system, are a preliminary heating means utilizing electrothermal transducers or a combination of other heater elements and the electrothermal transducers, and a means for carrying out preliminary ejection of ink independently of the ejection for recording. These systems are effective for reliable recording.

The number and type of recording heads to be mounted on a recording apparatus can be also changed. For example, only one recording head corresponding to a single color ink, or a plurality of recording heads corresponding to a plurality of inks different in color or concentration can be used. In other words, the present invention can be effectively applied to an apparatus having at least one of the monochromatic, multi-color and full-color modes. Here, the monochromatic mode performs recording by using only one major color such as black. The multi-color mode carries out recording by using different color inks, and the full-color mode performs recording by color mixing.

Furthermore, although the above-described embodiments use liquid ink, inks that are liquid when the recording signal is applied can be used: for example, inks can be employed that solidify at a temperature lower than the room temperature and are softened or liquefied in the room temperature. This is because in the ink jet system, the ink is generally temperature adjusted in a range of 30° C.–70° C. so that the viscosity of the ink is maintained at such a value that the ink can be ejected reliably.

In addition, the present invention can be applied to such apparatus Where the ink is liquefied just before the ejection by the thermal energy as follows so that the ink is expelled from the orifices in the liquid state, and then begins to solidify on hitting the recording medium, thereby preventing the ink evaporation: the ink is transformed from solid to liquid state by positively utilizing the thermal energy which would otherwise cause the temperature rise; or the ink, which is dry when left in air, is liquefied in response to the thermal energy of the recording signal. In such cases, the ink may be retained in recesses or through holes formed in a porous sheet as liquid or solid substances so that the ink faces the electrothermal transducers as described in Japanese Patent Application Laying-open Nos. 56847/1979 or 71260/1985. The present invention is most effective when it uses the film boiling phenomenon to expel the ink.

Furthermore, the ink jet recording apparatus of the present invention can be employed not only as an image output terminal of an information processing device such as a computer, but also as an output device of a copying machine including a reader, and as an output device of a facsimile apparatus having a transmission and receiving function.

The present invention has been described in detail with respect to various embodiments, and it will now be apparent from the foregoing to those skilled in the art that changes and modifications may be made without departing from the invention in its broader aspects, and it is the intention, therefore, in the appended claims to cover all such changes and modifications as fall within the true spirit of the invention.

What is claimed is:

1. An ink jet recording apparatus for recording an image by ejecting ink on a recording medium by using a recording head for ejecting ink, the apparatus comprising:

a carriage on which an ink storage unit for storing ink to be supplied to said recording head can be mounted;

moving means for moving said carriage in a predetermined region, said predetermined region having at least one of an acceleration region and a deceleration region;

datum detecting means for detecting a datum related to a moving velocity of said carriage, wherein said datum represents an average velocity or an acceleration rate of said carriage in said acceleration or said deceleration region of said predetermined region; and ink amount detecting means for detecting an amount of ink stored in said ink storage unit based on said datum detected by said datum detecting means.

2. An ink jet recording apparatus as claimed in claim 1, wherein said ink amount detecting means corrects said datum based on a period of time said ink jet recording apparatus has been used.

3. An ink jet recording apparatus as claimed in claim 1, wherein said ink amount detecting means corrects said datum based on an ambient temperature.

4. An ink jet recording apparatus as claimed in claim 1, wherein said moving means includes a motor for moving said carriage by a motor driving force.

5. An ink jet recording apparatus as claimed in claim 4, wherein said ink amount detecting means corrects said datum based on a temperature of said motor.

6. An ink jet recording apparatus as claimed in claim 1, wherein said ink amount detecting means detects said amount of ink stored in said ink storage unit based both on data detected by said datum detecting means when said ink storage unit is mounted on said carriage and when said ink storage unit is not mounted on said carriage.

7. An ink jet recording apparatus as claimed in claim 1, wherein said moving means moves said carriage by a driving force of a motor and said detecting means includes a sensor for detecting said carriage and detects a position of said sensor based on a period of time between a rise or a fall of a phase signal to said motor and a rise or a fall of a detection signal from said sensor, respectively, said detection being performed in a finer resolution than a resolution of said phase signal and said detected position being added to said datum.

8. An ink jet recording apparatus as claimed in claim 7, wherein an electric power supplied to said sensor is turned on only when said ink amount detecting means performs the detection procedure.

9. An ink jet recording apparatus as claimed in claim 1, wherein said ink amount detecting means detects said amount of ink based on a datum related to said moving velocity detected in the past by said datum detecting means and based on a datum related to said moving velocity detected at present by said datum detecting means.

10. An ink jet recording apparatus as claimed in claim 1, wherein said recording head generates a bubble in an ink by using thermal energy and ejects said ink responsive to said generation of said bubble.

11. An ink jet recording apparatus for recording an image by ejecting ink on a recording medium by using a recording head for ejecting ink, the apparatus comprising:

a movable carriage on which an ink storage unit for storing ink to be supplied to said recording head can be removably mounted;

mount judgment means for judging whether or not said ink storage unit is mounted on said carriage;

datum detecting means for detecting a datum related to a moving velocity of said carriage; and ink amount detecting means for detecting an amount of ink stored in said ink storage unit based on said datum detected by said datum detecting means and responsive to a judgment result of said mount judgment means, wherein when said mount judgment means judges that said ink storage unit is not mounted on said carriage, said ink amount detecting means detects said amount of ink stored in said ink storage unit based both on data detected by said datum detecting means when said ink storage unit is mounted on said carriage and when said ink storage unit is not mounted on said carriage.

12. An ink jet recording apparatus as claimed in claim 11, wherein when said mount judgment means judges that said ink storage unit is mounted on said carriage, said ink amount detecting means detects said amount of ink stored in said ink storage unit based on an amount of ink estimated by an amount recorded by said ink jet recording apparatus and on said datum detected by said datum detecting means.

13. An ink jet recording apparatus as claimed in claim 12, wherein said ink amount detecting means detects said amount of ink when said recording medium does not exist in a ink ejection region of said recording head.

14. An ink jet recording apparatus as claimed in claim 13, wherein said ink amount detecting means detects said amount of ink in accordance with an amount recorded by said ink jet recording apparatus.

15. An ink jet recording apparatus as claimed in claim 14, wherein said ink amount detecting means detects said amount of ink in accordance with a period of time said ink jet recording apparatus has been used for recording.

16. An ink jet recording apparatus as claimed in claim 15, wherein said ink amount detecting means detects said amount of ink when said ink jet recording apparatus is not recording.

17. An ink jet recording apparatus as claimed in claim 11, wherein said ink amount detecting means further comprises an ink amount reservation judgment means for judging whether or not the amount of ink detected in the past by said ink amount detecting means can be used for detecting the amount of ink and said ink amount detecting means further detects the amount of ink stored in said ink storage unit responsive to a judgment result by said ink amount reservation judgment means.

18. An ink jet recording apparatus as claimed in claim 17, wherein when said ink amount reservation judgment means judges that said amount of ink detected in the past cannot be used for the detection of the amount of ink, by performing a plurality of movements of said carriage, each of said movements starting at different positions, said ink amount detecting means detects the amount of ink based on data related to a plurality of moving velocities corresponding to said plurality of movements of said carriage.

19. An ink jet recording apparatus as claimed in claim 17, further comprising an exchange judgment means for judging whether or not said ink storage unit is replaced for a new ink storage unit based on said amount of ink detected in the past, when said ink amount reservation judgment means judges that said amount of ink detected in the past can be used for the detection of the amount of ink.

20. An ink jet recording apparatus as claimed in claim 11, wherein said recording head generates a bubble in the ink by using thermal energy and ejects the ink responsive to said generation of the bubble.

21. An ink jet recording apparatus for recording an image by ejecting an ink on a recording medium by using a recording head for ejecting an ink, the apparatus comprising:

a carriage on which an ink storage unit for storing ink to be supplied to said recording head can be mounted;

moving means for moving said carriage in a predetermined region, said predetermined region having at least. one of an acceleration region and a deceleration region;

datum detecting means for detecting a datum related to a moving velocity of said carriage, wherein said datum represents an average velocity or an acceleration rate of said carriage in said acceleration region or said deceleration region of said predetermined region;

ink amount estimation means for estimating an amount of ink based on a recording amount recorded by said ink jet recording apparatus; and ink amount detecting means for detecting an amount of ink stored in said ink storage unit based on said datum detected by said datum detecting means and said amount of ink estimated by said ink amount estimation means, wherein said ink amount detecting means performs said detecting in accordance with a detection timing and in accordance with the recording amount recorded by said ink jet recording apparatus.

22. An ink jet recording apparatus as claimed in claim 21, further comprising exchange detecting means for detecting an exchange of said ink storage unit in accordance with a comparison of the amount of ink detected based on the datum detected by said datum detecting means with the amount of ink estimated by said ink amount estimation means.

23. An ink jet recording apparatus as claimed in claim 21, wherein said recording head generates a bubble in the ink by using thermal energy and ejects the ink responsive to said generation of the bubble.

24. An ink jet recording apparatus for recording an image by ejecting ink on a recording medium by using a recording head for ejecting ink, the apparatus comprising:

a movable carriage on which an ink storage unit for storing ink to be supplied to said recording head can be mounted;

driving means for moving said carriage;

datum detecting means for detecting a datum related to a moving velocity of said carriage;

ink amount detecting means for detecting an amount of ink stored in said ink storage unit based on said datum detected by said datum detecting means; and exchange judgment means for judging whether or not said ink storage unit is replaced for a new ink storage unit based on said amount of ink detected by said ink amount detecting means in the past.

25. An ink jet recording apparatus as claimed in claim 24, further comprising an ejection restoration means for performing an ejection restoration operation for said recording head, said ejection restoration means performing said restoration operation when said exchange judgment means judges that said ink storage unit is replaced for a new ink storage unit.

26. An ink jet recording apparatus as claimed in claim 24, wherein said recording head generates a bubble in the ink by using thermal energy and ejects the ink responsive to said generation of the bubble.

27. An ink jet recording apparatus for recording an image by ejecting ink on a recording medium by using a recording head for ejecting ink, the apparatus comprising:

a carriage on which an ink storage unit for storing ink to be supplied to said recording head can be mounted;

moving means for moving said carriage in a predetermined region said predetermined region having at least one of an acceleration region and a deceleration region;

datum detecting means for detecting a datum related to a moving velocity of said carriage, wherein said datum represents an average velocity or an acceleration rate of said carriage in said acceleration or said deceleration region of said predetermined region; and head driving control means for changing a driving condition for said recording head responsive to said datum detected by said datum detecting means.

28. An ink jet recording apparatus according to claim 27, wherein said head driving control means changes the driving condition by controlling a driving frequency of said recording head.

29. An ink jet recording apparatus for recording an image by ejecting ink on a recording medium by using a recording head for ejecting ink, the apparatus comprising:

a movable carriage on which an ink storage unit for storing ink to be supplied to said recording head can be mounted;

driving means for moving said carriage;

datum detecting means for detecting a datum related to a moving velocity of said carriage; and ink amount detecting means for detecting an amount of ink stored in said ink storage unit based on said datum detected by said datum detecting means, said datum having been corrected based on a period of time that said ink jet recording apparatus has been used.

30. An ink recording apparatus as claimed in claim 29, wherein said driving means includes a motor for moving said carriage by a motor driving force.

31. An ink jet recording apparatus as claimed in claim 30, wherein said ink amount detection means corrects said datum based on a temperature of said motor.

32. An ink jet recording apparatus as claimed in claim 29, wherein said recording head generates a bubble in the ink by using thermal energy and ejects the ink responsive to said generation of the bubble.

33. An ink jet recording apparatus for recording an image by ejecting ink on a recording medium by using a recording head for ejecting ink, the apparatus comprising:

a carriage on which an ink storage unit for storing ink to be supplied to said recording head can be mounted;

moving means for moving said carriage in a predetermined region, said predetermined region having at least one of an acceleration region and a deceleration region;

datum detecting means for detecting a datum related to a moving velocity of said carriage, wherein said datum represents an average velocity or an acceleration rate of said carriage in said acceleration or said deceleration region of said predetermined region; and ink amount detecting means for detecting an amount of ink stored in said ink storage unit based on said datum detected by said datum detecting means, said datum being corrected based on an ambient temperature.

34. An ink jet recording apparatus as claimed in claim 33, wherein said moving means includes a motor for moving said carriage by a motor driving force.

35. An ink jet recording apparatus as claimed in claim 34, wherein said ink amount detecting means corrects said datum based on a temperature of said motor.

36. An ink jet recording apparatus for recording an image by ejecting ink on a recording medium by using a recording head for ejecting ink, the apparatus comprising:

a carriage on which an ink storage unit for storing ink to be supplied to said recording head can be mounted;

moving means for moving said carriage in a predetermined region, said predetermined region having at least one of an acceleration region and a deceleration region, said moving means including a motor for moving said carriage by a motor driving force;

datum detecting means for detecting a datum related to a moving velocity of said carriage, wherein said datum represents an average velocity or an acceleration rate of said carriage in said acceleration region or said deceleration region of said predetermined region; and ink amount detecting means for detecting an amount of ink stored in said ink storage unit based on said datum detected by said datum detecting means, said datum being corrected based on a temperature of said motor.

37. An ink jet recording apparatus as claimed in claim 36, wherein said recording head generates a bubble in the ink by using thermal energy and ejects the ink responsive to said generation of the bubble.

38. An ink jet recording apparatus for recording an image by ejecting ink on a recording medium by using a recording head for ejecting ink, the apparatus comprising:

a movable carriage on which an ink storage unit for storing ink to be supplied to said recording head can be mounted;

driving means for moving said carriage;

datum detecting means for detecting a datum related to a moving velocity of said carriage; and ink amount detecting means for detecting an amount of ink stored in said ink storage unit based on a datum related to said moving velocity detected in the past by said datum detecting means and based on a datum related to said moving velocity detected at present by said datum detecting means.

39. An ink jet recording apparatus as claimed in claim 38, wherein said recording head generates a bubble in the ink by using thermal energy and ejects the ink responsive to said generation of the bubble.

40. An ink jet recording apparatus for recording an image by ejecting ink on a recording medium by using a recording head for ejecting ink, the apparatus comprising:

a carriage, on which an ink storage unit for storing ink supplied to said recording head can be mounted, being formed so as to be movable;

moving means for moving said carriage;

datum detecting means for detecting a datum related to a moving velocity of said carriage on which said ink storage unit is mounted;

detecting means for detecting at least a variation in an amount of ink stored in said ink storage unit, on a basis of said datum detected by said datum detecting means; and correcting means for correcting said datum detected by said datum detecting means in accordance with information related to a friction load when said carriage is being moved.

* * * * *

UNITED STATES PATENT AND TRADEMARK OFFICE

CERTIFICATE OF CORRECTION

PATENT NO. : 5,657,057

DATED : August 12, 1997

INVENTOR(S) : HIROHARU NAKAJIMA ET AL.

It is certified that error appears in the above-identified patent and that said Letters Patent is hereby corrected as shown below:

ON TITLE PAGE, AT [56] REFERENCES CITED, FOREIGN PATENT DOCUMENTS

"3218845 9/1991 Japan" should read --3-218845 9/1991 Japan--.

COLUMN 2

Line 4, "response" should read --responsive--;
Line 47, "Further" should read --A further--;
Line 49, "responsive" should read --response--;
Line 51, "And" should read --A still--;
Line 54, "responsive" should read --response--.

COLUMN 3

Line 32, "responsive" should read --response--.

COLUMN 4

Line 4, "a" should read --an--;
Line 39, "responsive" should read --response--.

COLUMN 5

Line 26, "responsive" should read --response--;
Line 31, "responsive" should read --response--.

COLUMN 6

Line 4, "in which" should read --as an example of--.

UNITED STATES PATENT AND TRADEMARK OFFICE

CERTIFICATE OF CORRECTION

PATENT NO. : 5,657,057

DATED : August 12, 1997

INVENTOR(S) : HIROHARU NAKAJIMA ET AL.

It is certified that error appears in the above-identified patent and that said Letters Patent is hereby corrected as shown below:

COLUMN 7
Line 12, "an" should read --a--.

COLUMN 8
Line 28, "that," should read --that--;
Line 31, "are" should be deleted;
Line 32, "a" should read --an--.

COLUMN 10
Line 13, "step Sill" should read --step S111--.

COLUMN 11
Line 18, "and" should be deleted.

COLUMN 13
Line 29, "ROM102." should read --ROM 102.--;
Line 51, "sheet" should read --sheets--.

COLUMN 14
Line 6, "temperature" should be deleted.

COLUMN 15
Line 44, "RAM104," should read --RAM 104,--.

COLUMN 16
Line 3, "in" should be deleted;
Line 6, "in" should be deleted'
Line 55, "followings," should read --following,--.

UNITED STATES PATENT AND TRADEMARK OFFICE

CERTIFICATE OF CORRECTION

PATENT NO. : 5,657,057

DATED : August 12, 1997

INVENTOR(S) : HIROHARU NAKAJIMA ET AL.

It is certified that error appears in the above-identified patent and that said Letters Patent is hereby corrected as shown below:

COLUMN 18
Line 6, "move," should read --moves,--;
Line 36, "d2," should read --$d_2$,--;
Line 49, "procedure" should read --procedures--.

COLUMN 20
Line 22, "M3," should read --$M_3$,--;
Line 24, "M3" should read --$M_3$--.

COLUMN 21
Line 5, "ROM102" should read --ROM 102--;
Line 28, "ROM102." should read --ROM 102.--.

COLUMN 23
Line 10, "designate" should read --designated--;
Line 21, "followings," should read --following,--.

COLUMN 25
Line 66, "Where" should read --where--

COLUMN 27
Line 52, "a" should read --an--.

UNITED STATES PATENT AND TRADEMARK OFFICE

CERTIFICATE OF CORRECTION

PATENT NO. : 5,657,057

DATED : August 12, 1997

INVENTOR(S) : HIROHARU NAKAJIMA ET AL.

It is certified that error appears in the above-identified patent and that said Letters Patent is hereby corrected as shown below:

COLUMN 28
Line 32, "least." should read --least--.

COLUMN 29
Line 62, "detection" should read --detecting--.

Signed and Sealed this

Fourteenth Day of April, 1998

Bruce Lehman

*Attest:*

BRUCE LEHMAN

*Attesting Officer*

*Commissioner of Patents and Trademarks*